US006571561B1

(12) United States Patent
Aquino et al.

(10) Patent No.: US 6,571,561 B1
(45) Date of Patent: Jun. 3, 2003

(54) POWER GENERATION SYSTEM

(76) Inventors: Giovanni Aquino, 29 Byron Ave., Kenmore, NY (US) 14223; Ewan Choroszylow, 125 Church St., East Aurora, NY (US) 14052; Howard J. Greenwald, 111 Hickory Ridge Rd., Rochester, NY (US) 14625

( * ) Notice: Subject to any disclaimer, the term of this patent is extended or adjusted under 35 U.S.C. 154(b) by 47 days.

(21) Appl. No.: 09/775,292

(22) Filed: Feb. 1, 2001

Related U.S. Application Data

(63) Continuation-in-part of application No. 09/672,804, filed on Sep. 28, 2000, which is a continuation-in-part of application No. 09/536,332, filed on May 24, 2000, now Pat. No. 6,266,952, which is a continuation-in-part of application No. 09/441,312, filed on Nov. 16, 1999, now Pat. No. 6,213,744, which is a continuation-in-part of application No. 09/416,291, filed on Oct. 14, 1999, which is a continuation-in-part of application No. 09/396,034, filed on Sep. 15, 1999, now Pat. No. 6,301,898, which is a continuation-in-part of application No. 09/181,307, filed on Oct. 28, 1998, now abandoned.

(51) Int. Cl.[7] ..... F02G 3/00
(52) U.S. Cl. ..... 60/772; 60/39.12; 60/39.465
(58) Field of Search ..... 60/772, 39.464, 60/39.465, 39.12

(56) References Cited

U.S. PATENT DOCUMENTS 2,192,885 A * 3/1940 Avery ..... 266/159
5,165,236 A * 11/1992 Nieminen ..... 60/39.464

* cited by examiner

*Primary Examiner*—Charles G. Freay
(74) *Attorney, Agent, or Firm*—Greenwald & Basch LLP; Howard J. Greenwald

(57) ABSTRACT

A process for generating electricity in which a gas/liquid mixture is compressed in a compressor, partially purified in an accumulator/separator, partially purified in a coalescent filter, subjected to pressure regulation, and then fed to a microturbine. The microturbine produces a direct current which is used to drive a direct current motor which, in turn, drives a generator which produces alternating current.

9 Claims, 30 Drawing Sheets

POWER GENERATION SYSTEM

CROSS-REFERENCE TO RELATED PATENT APPLICATIONS

This application is a continuation-in-part of applicants' patent application U.S. Ser. No. 09/672,804, filed on Sep. 28, 2000, which was a continuation-in-part of patent application U.S. Ser. No. 09/536,332, filed on Mar. 24, 2000, now U.S. Pat. No. 6,266,952, which was a continuation-in-part of copending patent application U.S. Ser. No. 09/416,291, filed on Oct. 14, 1999, which was a continuation-in-part of patent application U.S. Ser. No. 09/396,034, filed on Sep. 15, 1999, now U.S. Pat. No. 6,301,898, which in turn was a continuation-in-part of patent application U.S. Ser. No. 09/181,307, filed on Oct. 28, 1998, abandoned.

This application is also a continuation-in-part of applicant's patent application U.S. Ser. No. 09/441,312, filed on Nov. 16, 1999 now U.S. Pat. No. 6,213,744.

FIELD OF THE INVENTION

A power generation system for generating electricity in which a compressor, a pump, and a prime mover are operatively connected to each other.

BACKGROUND OF THE INVENTION

Microturbines, also known as turbogenerators and turboalternators, are gaining increasing popularity and acceptance. These microturbines are often used in conjunction with one or more compressors which supply gaseous fuel to them at a desired pressure, generally from about 40 to about 500 pounds per square inch.

The microturbines are often employed in a system comprising two or more microturbines. These systems could be supplied by only one compressor, but such operation often results in too much compressor capacity when less than all of the microturbines are operating.

It is an object of this invention to provide a process for controlling the output of a multiplicity of compressors connected to one or more microturbines.

SUMMARY OF THE INVENTION

A power generation system comprised of a guided rotor compressor, a liquid injection metering pump operatively connected to such compressor, and a prime mover to which the output of the compressor is fed.

BRIEF DESCRIPTION OF THE DRAWINGS

The claimed invention will be described by reference to the specification and the following drawings, in which:

and

Figure 47A:
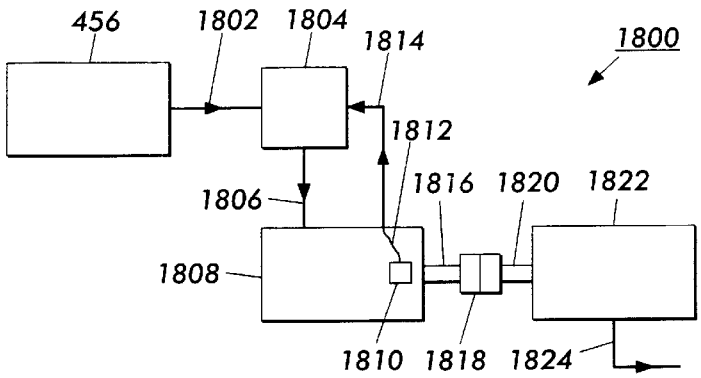
Figure 47B:
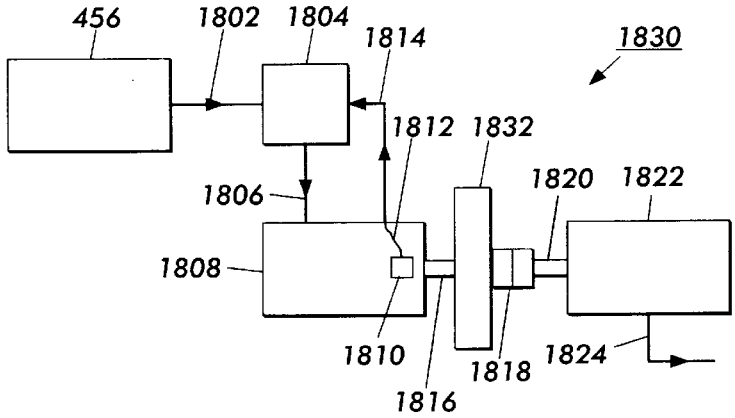
Figure 47C:
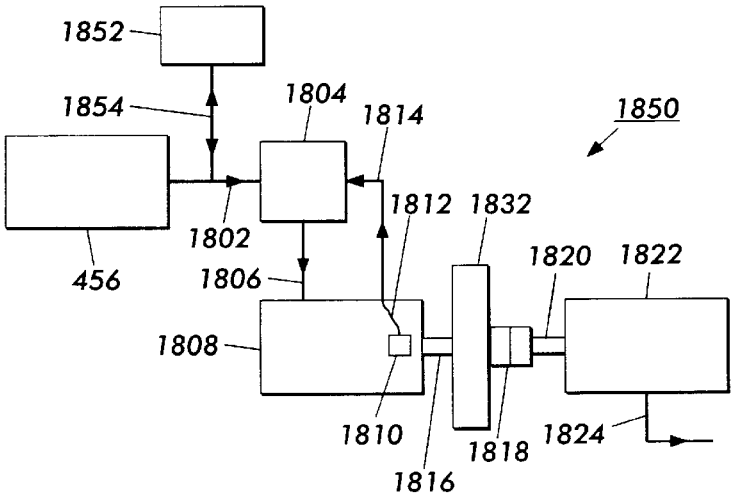

FIGS. 47A, 47B, and 47C are schematics of novel power generation systems.

DESCRIPTION OF THE PREFERRED EMBODIMENTS

In the first part of this specification, applicants will describe a system for generating electricity. In the second part of this specification, applicants will describe a system for controlling the amount of gas delivered in an electrical generating system comprised of two or more microturbines. In the third part of this specification, applicants will describe several novel compressor assemblies.

FIGS. 1, 2, 3, 4, 4A, 5, 6, 7, and 8 are identical to the FIGS. 1, 2, 3, 4, 4A, 5, 6, 7, and 8 appearing in U.S. Pat. No. 5,431,551; and they are presented in this case to illustrate the similarities and differences between the rotary positive displacement device of such patent and the rotary positive displacement device of the instant application. The entire disclosure, the drawings, the claims, and the abstract of U.S. Pat. No. 5,431,551 are hereby incorporated by reference into this specification.

Referring to FIGS. 1 through 8, and to the embodiment depicted therein, it will be noted that rollers 18, 20, 22, and 24 (see FIGS. 1 and 8) are solid. In the rotary positive displacement device of the instant invention, however, the rollers used are hollow.

Figure 9:
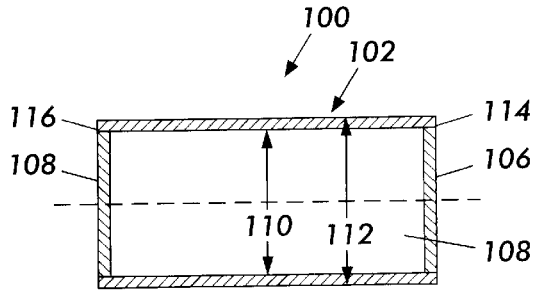
FIG. 9 is a sectional view of one hollow roller which can be used in the rotary positive displacement device of this invention.

FIG. 9 is a sectional view of a hollow roller 100 which may be used to replace the rollers 18, 20, 22, and 24 of the device of FIGS. 1 through 8. In the preferred embodiment depicted, it will be seen that roller 100 is a hollow cylindricral tube 102 with ends 104 and 106.

Tube 102 may consist of metallic and/or non-metallic material, such as aluminum, bronze, polyethyletherketone, reinforced plastic, and the like. The hollow portion 108 of tube 102 has a diameter 110 which is at least about 50 percent of the outer diameter 112 of tube 102.

The presence of ends 106 and 108 prevents the passage of gas from a low pressure region (not shown) to a high pressure region (not shown). These ends may be attached to tube 102 by conventional means, such as adhesive means, friction means, fasteners, threading, etc.

In the preferred embodiment depicted, the ends 106 and 108 are aligned with the ends 114 and 116 of tube 102. In another embodiment, either or both of such ends 106 and 108 are not so aligned.

In one embodiment, the ends 106 and 108 consist essentially of the same material from which tube 102 is made. In another embodiment, different materials are present in either or both of ends 106 and 108, and tube 102.

In one embodiment, one of ends 106 and/or 108 is more resistant to wear than another one of such ends, and/or is more elastic.

Figure 10:
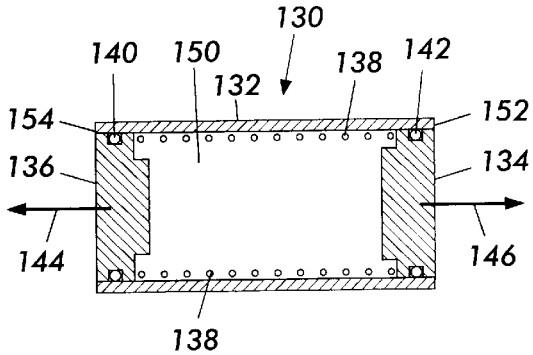
FIG. 10 is a sectional view of another hollow roller which can be used in the rotary positive displacement device of this invention.

FIG. 10 is sectional view of another preferred hollow roller 130, which is comprised of a hollow cylindrical tube 132, end 134, end 136, resilient means 138, and O-rings 140 and 142. In this embodiment, a spring 138 is disposed between and contiguous with ends 134 and 136, urging such ends in the directions of arrows 144 and 146, respectively. It will be appreciated that these spring-loaded ends tend to minimize the clearance between roller 130 and the housing in which it is disposed; and the O-rings 140 and 142 tend to prevent gas and/or liquid from entering the hollow center section 150.

In the preferred embodiment depicted, the ends 144 and 146 are aligned with the ends 152 and 154 of tube 132. In another embodiment, not shown, one or both of ends 144 and/or 146 are not so aligned.

The resilient means 138 may be, e.g., a coil spring, a flat spring, and/or any other suitable resilient biasing means.

Figure 11:
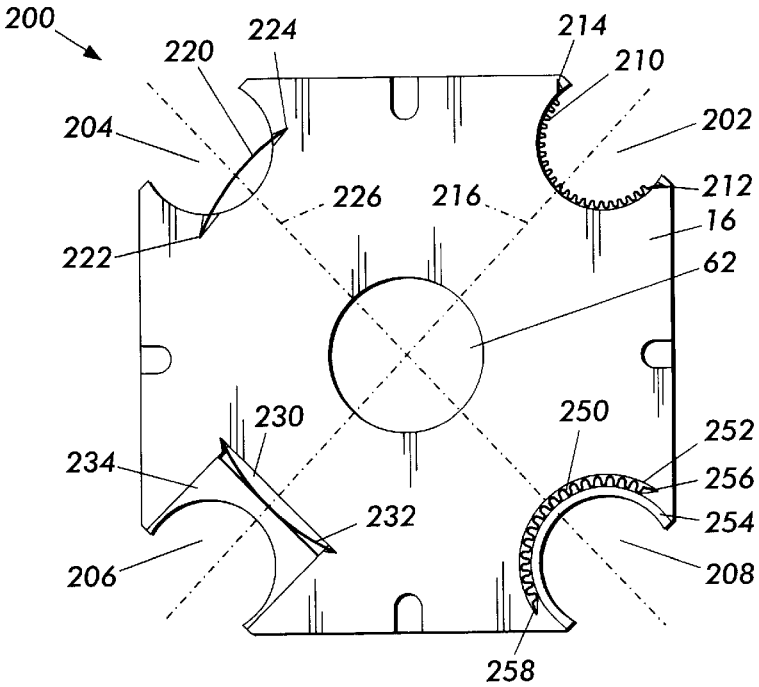
FIG. 11 is a schematic view of a modified rotor which can be used in the positive displacement device of this invention.

FIG. 11 is a schematic view of a rotor 200 which may be used in place of the rotor 16 depicted in FIGS. 1, 5, 6, 7, and 8. Referring to FIG. 11, partial bores 202, 204, 206, and 208 are similar in function, to at least some extent, the partial bores 61, 63, 65, and 67 depicted in FIGS. 5, 6, 7, and 8. Although, in FIG. 11, a different partial bore has been depicted for elements 202, 204, 206, and 208, it will be appreciated that this has been done primarily for the sake of simplicity of representation and that, in most instances, each of partial bores 61, 63, 65, and 67 will be substantially identical to each other.

It will also be appreciated that the partial bores 202, 204, 206, and 208 are adapted to be substantially compliant to the forces and loads exerted upon the rollers (not shown) disposed within said partial bores and, additionally, to exert an outwardly extending force upon each of said rollers (not shown) to reduce the clearances between them and the housing (not shown).

Referring to FIG. 11, partial bore 202 is comprised of a ribbon spring 210 removably attached to rotor 16 at points 212 and 214. Because of such attachment, ribbon spring 210 neither rotates nor slips during use. The ribbon spring 210 may be metallic or non-metallic.

In one embodiment, depicted in FIG. 11, the ribbon spring 210 extends over an arc greater than 90 degrees, thereby allowing it to accept loads at points which are far from centerline 216.

Partial bore 204 is comprised of a bent spring 220 which is affixed at ends 222 and 224 and provides substantially the same function as ribbon spring 210. However, because bent spring extends over an arc less than 90 degrees, it accepts loads primarily at our around centerline 226.

Partial bore 206 is comprised of a cavity 230 in which is disposed bent spring 232 and insert 234 which contains partial bore 206. It will be apparent that the roller disposed within bore 206 (and also within bores 202 and 204) are trapped by the shape of the bore and, thus, in spite of any outwardly extending resilient forces, cannot be forced out of the partial bore. In another embodiment, not shown, the partial bores 202, 204, 206, and 208 do not extend beyond the point that rollers are entrapped, and thus the rollers are free to partially or completely extend beyond the partial bores.

Referring again to FIG. 11, it will be seen that partial bore 208 is comprised of a ribbon spring 250 which is similar to ribbon spring 210 but has a slightly different shape in that it is disposed within a cavity 252 behind a removable cradle 254. As will be apparent, the spring 250 urges the cradle 254 outwardly along axis 226. Inasmuch as the spring 250 extends more than about 90 degrees, it also allows force vectors near ends 256 and 258, which, in the embodiment depicted, are also attachment points for the spring 250.

Figure 12:
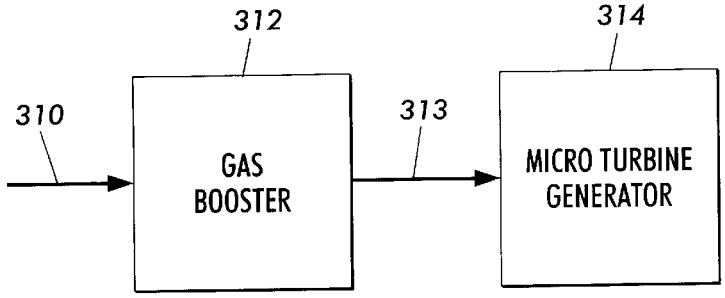
FIG. 12 is a block diagram of a preferred electrical generation system.

FIG. 12 is a block diagram of one preferred apparatus of the invention. Referring to FIG. 12, it will be seen that gas (not shown) is preferably passed via gas line 310 to gas booster 312 in which it is compressed to a pressure required by micro turbine generator 314. In general, the gas must be compressed to a pressure in excess of 30 p.s.i.g., although pressures as low as about 20 p.s.i.g. and as high as 360 p.s.i.g. or more also may be used.

Figure 13:
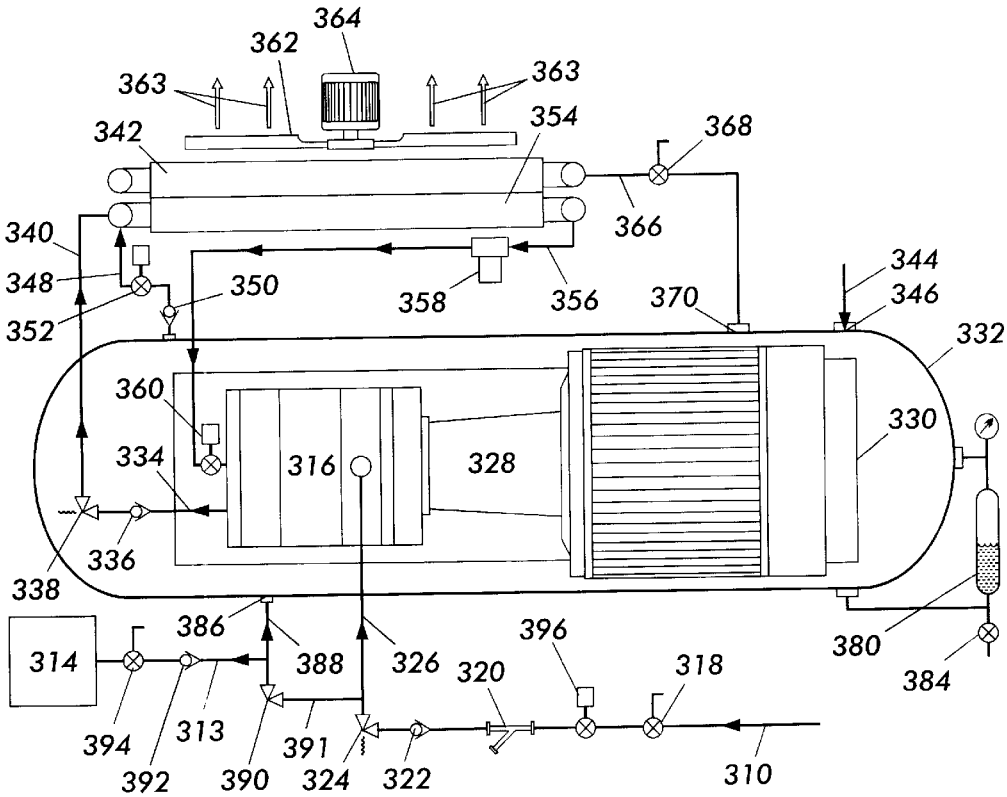
FIG. 13 is a block diagram of the gas booster system of FIG. 12.

In FIGS. 12 and 13, a micro turbine generator 314 is shown as the preferred receiver of the gas via line 313. In other embodiments, not shown, a larger gas turbine and/or a fuel cell may be substituted for the micro turbine generator 314.

In one embodiment, in addition to increasing the pressure of the natural gas, the gas booster 312 also generally increases its temperature to a temperature within the range of from about 100 to about 150 degrees Fahrenheit. In one embodiment, the gas booster 312 increases the temperature of the natural gas from pipeline temperature to a temperature of from about 100 to about 120 degrees Fahrenheit.

The compressed gas from gas booster 312 is then fed via line 313 to micro turbine generator 314. The components used in gas booster 312 and in micro turbine generator 314 will now be described.

FIG. 13 is a schematic diagram of the gas booster system 312 of FIG. 12. Referring to FIG. 12, it will be seen that gas booster system 312 preferably is comprised of a guided rotor compressor 316.

The guided rotor compressor 316 depicted in FIG. 13 is substantially identical to the guided rotor compressor 10 disclosed in U.S. Pat. No. 5,431,551, the entire disclosure of which is hereby incorporated by reference into this patent application. This guided rotor compressor is preferably comprised of a housing comprising a curved inner surface with a profile equidistant from a trochoidal curve, an eccentric mounted on a shaft disposed within said housing, a first rotor mounted on said eccentric shaft which is comprised of a first side, a second side, and a third side, a first partial bore disposed at the intersection of said first side and said second side, a second partial bore disposed at the intersection of said second side and said third side, a third partial bore disposed at the intersection of said third side and said first side, a first solid roller disposed and rotatably mounted within said first partial bore, a second solid roller disposed and rotatably mounted within said second partial bore, and a third solid roller disposed and rotatably mounted within said third partial bore.

The rotor is comprised of a front face, a back face, said first side, said second side, and said third side. A first opening is formed between and communicates between said front face and said first side, a second opening is formed between and communicates between said back face and said first side, wherein each of said first opening and said second opening is substantially equidistant and symmetrical between said first partial bore and said second partial bore. A third opening is formed between and communicates between said front face and said second side. A fourth opening is formed between and communicates between said back face and said second side, wherein each of said third opening and said fourth opening is substantially equidistant and symmetrical between said second partial bore and said third partial bore. A fifth opening is formed between and communicates between said front face and said third side. A sixth opening is formed between and communicates between said back face and said third side, wherein each of said fifth opening and said sixth opening is substantially equidistant and symmetrical between said third partial bore and said first partial bore.

Each of said first partial bore, said second partial bore, and said third partial bore is comprised of a centerpoint which, as said rotary device rotates, moves along said trochoidal curve.

Each of said first opening, said second opening, said third opening, said fourth opening, said fifth opening, and said sixth opening has a substantially U-shaped cross-sectional shape defined by a first linear side, a second linear side, and an arcuate section joining said first linear side and said second linear side. The first linear side and the second linear side are disposed with respect to each other at an angle of less than ninety degrees; and said substantially U-shaped cross-sectional shape has a depth which is at least equal to its width.

The diameter of said first roller is equal to the diameter of said second solid roller, and the diameter of said second solid roller is equal to the diameter of said third solid roller.

The widths of each of said first opening, said second opening, said third opening, said fourth opening, said fifth opening, and said sixth opening are substantially the same, and the width of each of said openings is less than the diameter of said first solid roller.

Each of said first side, said second side, and said third side has substantially the same geometry and size and is a composite shape comprised of a first section and a second section, wherein said first section has a shape which is different from that of said second section.

The aforementioned compressor is a very preferred embodiment of the rotary positive displacement compressor which may be used as compressor 316; it is substantially smaller, more reliable, more durable, and quieter than prior art compressors. However, one may use other rotary positive displacement compressors such as, e.g., one or more of the compressors described in U.S. Pat. Nos. 5,605,124, 5,597,287, 5,537,974, 5,522,356, 5,489,199, 5,459,358, 5,410,998, 5,063,750, 4,531,899, and the like. The entire disclosure of each of these United States patents is hereby incorporated by reference into this specification.

In one preferred embodiment, the rotary positive displacement compressor used as compressor 316 is a Guided Rotor Compressor which is sold by the Combined Heat and Power, Inc. of 210 Pennsylvania Avenue, East Aurora, N.Y.

Referring again to FIG. 13, it will be seen that the compressed gas from compressor 316 is fed via line 313 to micro turbine generator 314. As is disclosed in U.S. Pat. No.

Figure 1:
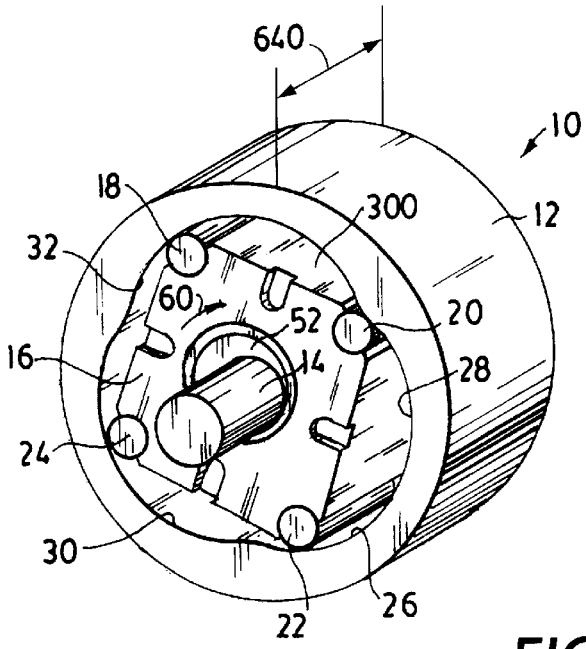
FIG. 1 PRIOR ART
FIG. 1 is a perspective view of one preferred rotary mechanism claimed in U.S. Pat. No. 5,431,551.
Figure 2:
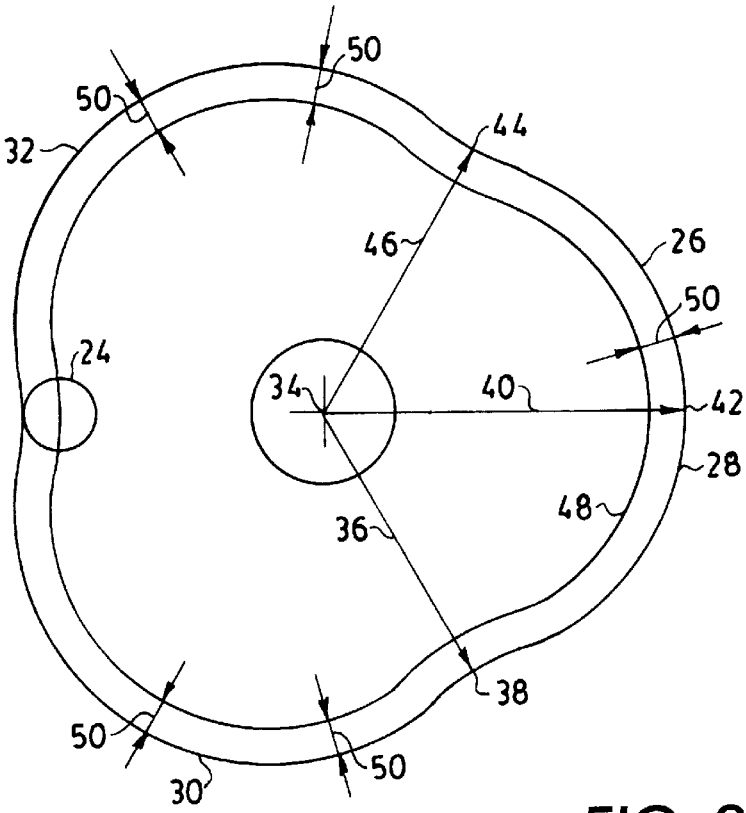
FIG. 2 PRIOR ART
FIG. 2 is an axial, cross-sectional view of the mechanism of FIG. 1.
Figure 3:
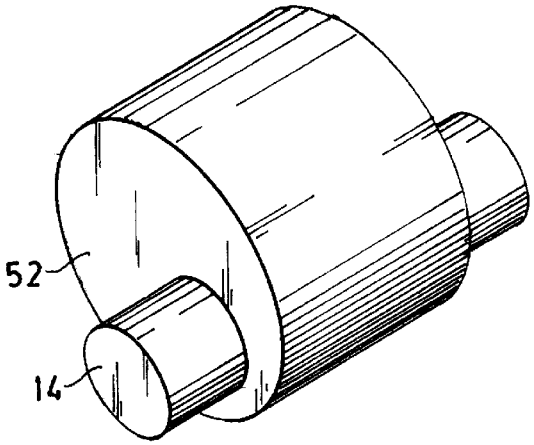
FIG. 3 PRIOR ART
FIG. 3 is a perspective view of the eccentric crank of the mechanism of FIG. 1.

5,819,524 (see, e.g., claim 1 thereof), such micro turbine generator 314 is a turbogenerator set including a turbogenerator power controller, wherein said turbogenerator also includes a compressor, a turbine, a combustor with a plurality of gaseous fuel nozzles and a plurality of air inlets, and a permanent magnet motor generator; see, e.g., FIGS. 1 and 2 of such patent and the description associated with such Figures.

The assignee of U.S. Pat. No. 5,819,524 manufactures and sells micro turbine generators, such as those described in its patent.

Similar micro turbine generators 314 are also manufactured and sold by Elliott Energy Systems company of 2901 S.E. Monroe Street, Stuart, Fla. 34997 as "The TA Series Turbo Alternator."

Such micro turbines are also manufactured by the Northern Research and Engineering Corporation (NREC), of Boston, Mass., which is a wholly-owned subsidiary of Ingersoll-Rand Company; see, e.g., page 64 of the June, 1998 issue of "Diesel & Gas Turbine Worldwide." These micro turbines are adapted to be used with either generators (to produce micro turbine generators) or, alternatively, without such generators in mechanical drive applications. It will be apparent to those skilled in the art that applicants' rotary positive displacement device may be used with either of these applications.

In general, and as is known to those skilled in the art, the micro turbine generator 314 is comprised of a radial, mixed flow or axial, turbine and compressor and a generator rotor and stator. The system also contains a combustor, bearings and bearings lubrication system. The micro turbine generator 314 operates on a Brayton cycle of the open type; see, e.g., page 48 of the June, 1998 issue of "Diesel & Gas Turbine Worldwide."

Referring again to FIG. 13, and in the preferred embodiment depicted therein, it will be seen that natural gas is fed via line 310 to manual ball valve 318 and thence to Y-strainer 320, which removes any heavy, solid particles entrained within the gas stream. The gas is then passed to check valve 322, which prevents backflow of the natural gas. Relief valve 324 prevents overpressurization of the system.

The natural gas is then fed via line 326 to the compressor 316, which is described elsewhere in this specification in detail. Referring to FIG. 13, it will be seen that compressor 316 is operatively connected via distance piece 328, housing a coupling (not shown) which connects the shafts (not shown) of compressor 316 and electric motor 330. The compressor 316, distance piece 328, and electric motor 330 are mounted on or near a receiving tank, which receives and separates a substantial portion of the oil used in compressor 316.

Referring again to FIG. 13, when the compressor 316 has compressed a portion of natural gas, such natural gas also contains some oil. The gas/oil mixture is then fed via line 334 to check valve 336 (which prevents backflow), and thence to relief valve 338 (which prevents overpressurization), and then via line 340 to radiator/heat exchanger 342.

Referring again to FIG. 13, it will be seen that oil is charged into the system via line 344 through plug 346. Any conventional oil or lubricating fluid may be used; in one embodiment, automatic transmission fluid sold as "ATF" by automotive supply houses is used.

A portion of the oil which was introduced via line 344 resides in the bottom of tank 332. This portion of the oil is pressurized by the natural gas in the tank, and the pressurized oil is then pushed by pressurized gas through line 348, through check valve (to eliminate back flow), and then past needle valve 352, into radiator 354; a similar needle valve 352 may be used after the radiator 354. The oil flowing into radiator 354 is then cooled to a temperature which generally is from about 10 to about 30 degrees Fahrenheit above the ambient air temperature. The cooled oil then exits radiator 354 via line 356, passes through oil filter 358, and then is returned to compressor 316 where it is injected; the injection is controlled by solenoid valve 360.

In the preferred embodiment depicted in FIG. 13, a fan 362 is shown as the cooling means; this fan is preferably driven by motor 364; in the preferred embodiment depicted in FIG. 13, air is drawn through radiators 342 and 354 in the direction of arrows 363. As will be apparent to those skilled in the art, other cooling means (such as water cooling) also and/or alternatively may be used.

Referring again to FIG. 13, the cooled oil and gas mixture from radiator 342 is passed via line 366 through ball valve 368 and then introduced into tank 332 at point 370.

In the operation of the system depicted in FIG. 13, a sight gauge 380 provides visual indication of how much oil is in receiving tank 332. When an excess of such oil is present, it may be drained via manual valve 384. In general, it is preferred to have from about 20 to about 30 volume percent of the tank be comprised of oil.

Referring again to FIG. 13, compressed gas may be delivered to turbogenerator 314 through port 386, which is preferably located on receiving tank 332 but above the oil level (not shown) in such tank. Bypass line 388 and pressure relief valve 390 allows excess gas flow to be diverted back into inlet line 326. That gas which is not in bypass line 388 flows via line 313 through check valve 392 (to prevent backflow), manual valve 394 and thence to turbogenerator 314.

Thus, and again referring to FIG. 13, it will be seen that, in this preferred embodiment, there is a turbo alternator 314, an oil lubricated rotary displacement compressor 316, a receiving tank 332, a means 310 for feeding gas to the rotary positive displacement compressor, a means 346 for feeding oil to the receiving tank, a means 342 for cooling a mixture of gas and oil, a means 332 for separating a mixture of gas and oil, and a means 356 for feeding oil to the rotary positive displacement compressor.

In the preferred embodiment depicted in FIG. 13, there are two separate means for controlling the flow capacity of compressor 316. One such means, discussed elsewhere in this specification as a bypass loop (such as, e.g., a bypass valve or regulator), is the combination of port 386, line 388, relief valve 390, and line 391. Another such means is to control the inlet flow of the natural gas by means of control valve 396. As will be apparent, both such means, singly or in combination, exert their control in response to the gas needs of turbogenerator 314. As will be apparent, other such means may be used. Thus, e.g., one may utilize a variable speed drive operatively connected to the compressor which will vary the compressor speed in response to the demand for compressed gas exhibited by the microturbine(s) or other primer mover(s). Such a variable speed drive is commercially available and may be obtained, e.g., as Fincor Electrics 6500 Series Adjustable Speed Act Motor Controller.

Figure 14:
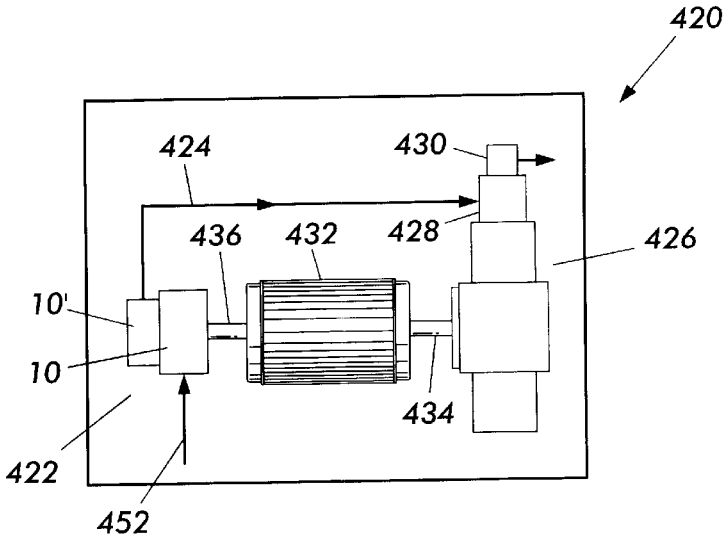
FIG. 14 is a schematic representation of an apparatus comprised of a guided rotor device and a reciprocating compressor.

FIG. 14 is a schematic representation of a hybrid booster system 420 which is comprised of a rotary positive displacement device assembly 422 operatively connected via line 424 to a reciprocating compressor 426.

Rotary positive displacement device assembly 422 may be comprised of one or more of the rotary positive displacement devices depicted in either FIGS. 1–8 (with solid rollers) and/or 9–11 (hollow rollers). Alternatively, or additionally, the displacement device 422 may be comprised of one or more of the rotary compressors claimed in U.S. Pat. No. 5,769,619, the entire disclosure of which is hereby incorporated by reference into this specification. A variable speed drive assembly may be operatively connected to one of these compressors. In one aspect of this embodiment, each compressor in the system is connected to a variable speed drive.

In one embodiment, a variable speed drive (not shown) is operatively connected to one compressor; and other compressors in the system are not operatively connected to such variable speed drive.

U.S. Pat. No. 5,769,619 claims a rotary device comprised of a housing comprising a curved inner surface in the shape of a trochoid and an interior wall, an eccentric mounted on a shaft disposed within said housing, a first rotor mounted on said eccentric shaft which is comprised of a first side and a second side, a first pin attached to said rotor and extending from said rotor to said interior wall of said housing, and a second pin attached to said rotor and extending from said rotor to said interior wall of said housing, and a third pin attached to said rotor and extending from said rotor to said interior wall of said housing. A continuously arcuate track is disposed within said interior wall of said housing, wherein said continuously arcuate track is in the shape of an envoluted trochoid. Each of said first pin, said second pin, and said third pin has a distal end which is disposed within said continuously arcuate track. Each of said first pin, said second pin, and said third pin has a distal end comprised of a shaft disposed within a rotatable sleeve. The rotor is comprised of a multiplicity of apices, wherein each such apex forms a compliant seal with said curved inner surface, and wherein each said apex is comprised of a separate curved surface which is formed from a strip of material pressed into a recess. The curved inner surface of the housing is generated from an ideal epictrochoidal curve and is outwardly recessed from said ideal epitrochoidal curve by a distance of from about 0.05 to about 5 times as great as the eccentricity of said eccentric. The diameter of the distal end of each of said first pin and said second pin is from about 2 to about 4 times as great as the eccentricity of the eccentric. Each of the first pin, the second pin, and the third pin extends from beyond the interior wall of the housing by from about 2 to about 2 times the diameter of each of said pins.

Referring again to FIG. 14, it is preferred that several rotary positive displacement devices 10 and 10' be used to compress the gas ultimately fed via line 424 to reciprocating positive compressor 426. As is disclosed in U.S. Pat. No. 5,431,551, the devices 10 and 10' are staged to provide a multiplicity of fluid compression means in series.

Thus, as was disclosed in U.S. Pat. No. 5,431,551 (see lines 62 et seq. of column 9), "In one embodiment, not shown, a series of four rotors are used to compress natural gas. The first two stacked rotors are substantially identical and relatively large; they are 180 degrees out of phase with each other; and they are used to compress natural gas to an intermediate pressure level of from about 150 to about 200 p.s.i.g. The third stacked rotor, which comprises the second stage of the device, is substantially smaller than the first two and compresses the natural gas to a higher pressure of from about 800 to about 1,000 p.s.i.g. The last stacked compressor, which is yet smaller, is the third stage of the device and compresses the natural gas to a pressure of from about 3,600 to about 4,500 p.s.i.g."

Many other staged compressor circuits will be apparent to those skilled in the art. What is common to all of them, however, is the presence of at least one rotary positive displacement device 10 whose output is directly or indirectly operatively connected to at least one cylinder of a reciprocating positive displacement compressor 426.

One may use any of the reciprocating positive displacement compressor designs well known to the art. Thus, by way of illustration and not limitation, one may use one or more of the reciprocating positive compressor designs disclosed in U.S. Pat. Nos. 5,811,669, 5,457,964, 5,411,054, 5,311,902, 4,345,880, 4332,144, 3,965,253, 3,719,749, 3,656,905, 3,585,451, and the like. The entire disclosure of each of these United States patents is hereby incorporated by reference into this specification.

Referring again to FIG. 14, it will be apparent that reciprocating positive displacement compressor 426 may be comprised of one or more stages. In the preferred embodiment depicted, compressor 426 is comprised of stages 428 and 430.

Referring again to FIG. 14, an electric motor 432 connected by shafts 434 and 436 is operatively connected to compressors 428/430 and 10/10'. It will be apparent that many other such drive assemblies may be used.

In one embodiment, not shown, the gas from one stage of either the 10/10' assembly and/or the 428/430 assembly is cooled prior to the time it is passed to the next stage. In this embodiment, it is preferred to cool the gas exiting each stage to a temperature of at least about 10 degrees Fahrenheit above ambient temperature prior to the time it is introduced to the next compressor stage.

Figure 15:
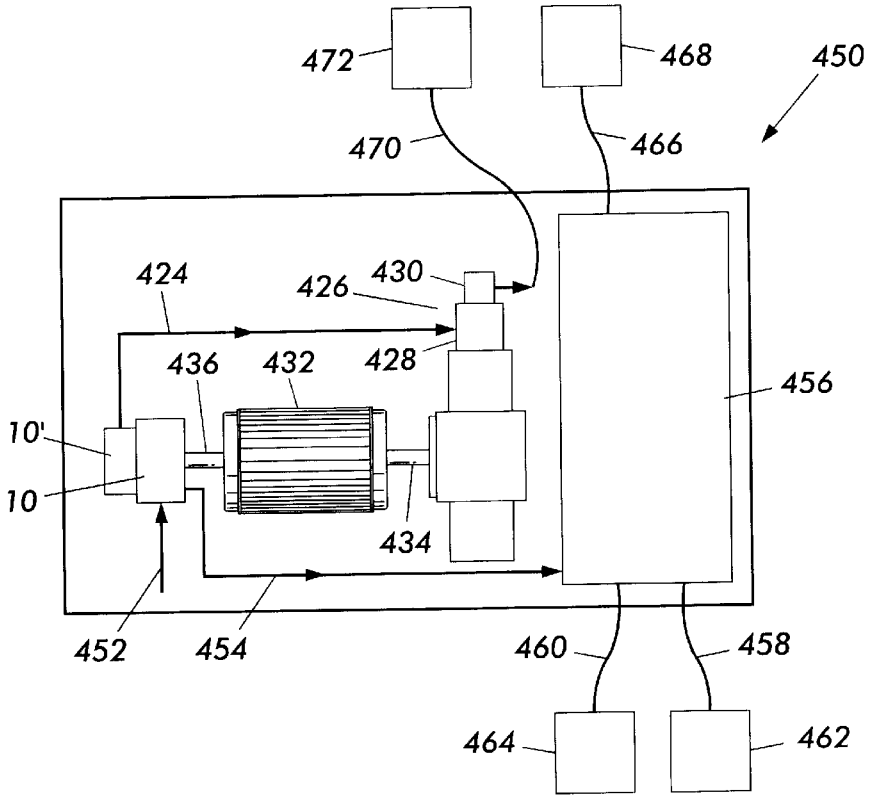
FIG. 15 is a schematic representation of another apparatus comprised of a guided rotor device and a reciprocating compressor.

FIG. 15 depicts an assembly 450 similar to the assembly 420 depicted in FIG. 14. Referring to FIG. 15, it will be seen that gas is fed to compressor assembly 10/10' by line 452. In this embodiment, some pressurized gas at an intermediate pressure is fed from compressor 10 via line 454 to turbine or micro-turbine or fuel cell 456. Alternatively, or additionally, gas is fed to electrical generation assembly 456 by a separate compressor (not shown).

The electrical output from electrical generation assembly 456 is used, at least in part, to power electrical motor 432. Additionally, electrical power is fed via lines 458 and/or 460 to an electrical vehicle recharging station 462 and/or to an electrical load 464.

Referring again to FIG. 15, and in the preferred embodiment depicted therein, waste heat produced in turbine/microturbine/fuel cell 456 is fed via line 466 to a heat load 468, where the heat can be advantageously utilized, such as, e.g., heating means, cooling means, industrial processes, etc. Additionally, the high pressure discharge from compressor 430 is fed via line 470 to a compressed natural gas refueling system 472.

Figure 16:
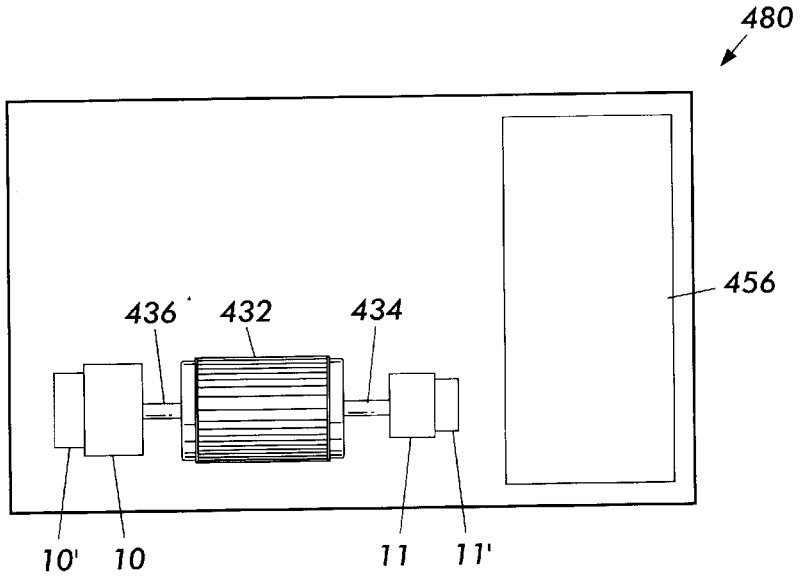
FIG. 16 is a schematic representation of another guided rotor apparatus.

In one embodiment, not shown, guided rotor assembly 10/10' is replaced by conventional compressor means such as reciprocating compressor, or other positive displacement compressor. Alternatively, or additionally, the reciprocating compressor assembly may be replaced by one or more rotary positive displacement devices which, preferably, are adapted to produce a more highly pressurized gas output than either compressor 10 or compressor 10'. Such an arrangement is illustrated in FIG. 16, wherein rotary positive displacement devices 11/11' are the higher pressure compressors. In one embodiment, not shown, separate electrical motors are used to power one or more different compressors.

Figure 17:
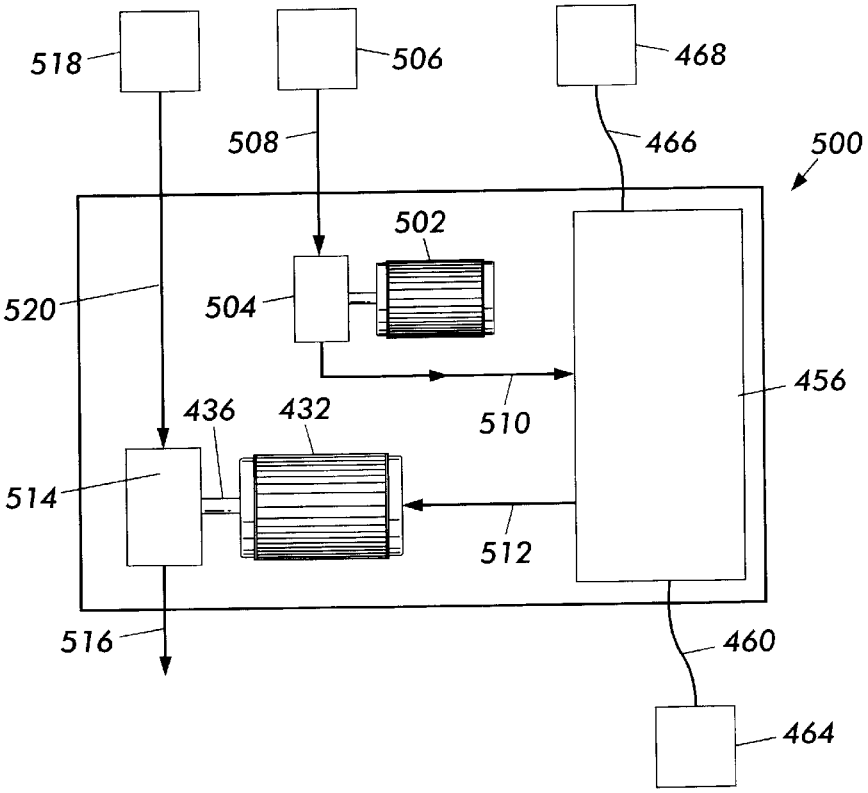
FIG. 17 is a schematic representation of yet another guided rotor apparatus.

FIG. 17 is a schematic representation of an assembly 500 in which electrical generation assembly 456 is used to power a motor 502 which is turn provides power to rotary positive displacement device 504. Gas from well head 506 is passed via line 508, and pressurized gas from rotary positive displacement device 504 is fed via line 510 to electrical generation assembly 456, wherein it is converted to electrical energy. Some of this energy is fed via line 512 to electric motor 432, which provides motive power to a single or multi-compressor guided rotary compressor 514; this "well head booster" may be similar in design to the compressor assembly illustrated in FIGS. 1–8, or to the compressor assembly illustrated in FIGS. 9–12, and it may contain one more compressor stages. The output from rotary positive displacement assembly 514 may be sent via line 516 to gas processing and/or gas transmission lines. The input to rotary positive displacement assembly 514 may come from well head 518, which may be (but need not be) the same well head as well head 506, via line 520.

Multistage Rotor Assembly

Figure 18:
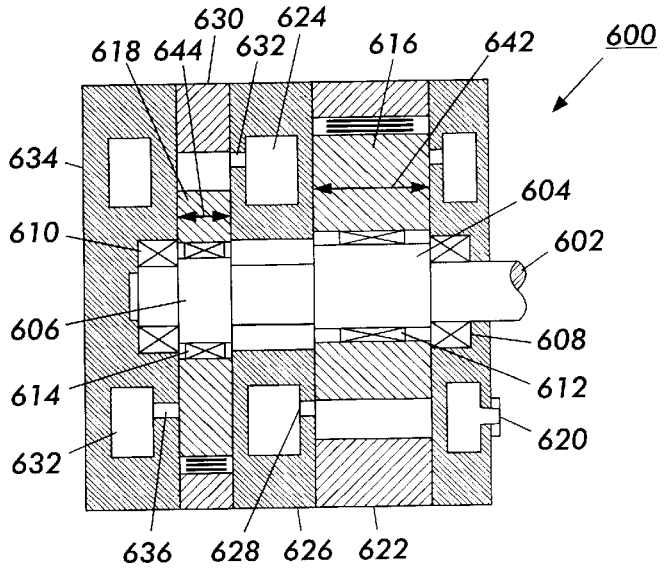
FIG. 18 is a sectional view of a multi-stage guided rotor assembly.

FIG. 18 is a sectional view of a multistage rotor assembly 600 which is comprised of a shaft 602 integrally connected to eccentric 604 and eccentric 606. The rotating shaft 600/eccentric 604/eccentric 606 assembly is supported by main bearings 608 and 610; eccentrics 604 and 606 are disposed within bearings 612 and 614; and the eccentrics 604/606 and bearings 612/614 assemblies are disposed within guided rotors 616 and 618. This arrangement is somewhat similar to that depicted in FIG. 1, wherein eccentric 52 is disposed within guided rotor 60.

As will be apparent to those skilled in the art, one shaft 602 is being used to translate two rotors 616 and 618. The gas to be compressed is introduced into port 620 and then introduced into the volume created by the rotor 616 and the housing 622. The compressed gas from the volume created by the rotor 616 and the housing 622 is then introduced within an annulus 624 within intermediate plate 626 via port 628 and then sent into the volume created by rotor 618 and housing 630 through port 632. After being further compressed in this second rotor system, it is then sent to discharge annulus 632 within discharge housing 634 by port 636.

Referring to FIG. 1, it will be seen that guided rotor assembly 10 has a housing 12 with a thickness 640 which is slightly larger than the thickness of the rotor 16 disposed within such housing (see FIG. 1). Similarly, the thickness 642 of rotor assembly 616, and the thickness 644 of rotor assembly 618 are also slightly smaller than the thicknesses of the housings in which the guided rotors are disposed.

It is preferred that the thickness 644 be less than the thickness 642. In one embodiment, thickness 642 is at least 1.1 times as great as the thickness 644 and, preferably, at least 1.5 times as great as the thickness 644.

It will be apparent that, with the assembly 600 of FIG. 18, one can achieve higher pressures with lower operating costs.

A Hermetically Sealed Guided Rotor Apparatus

Figure 19:
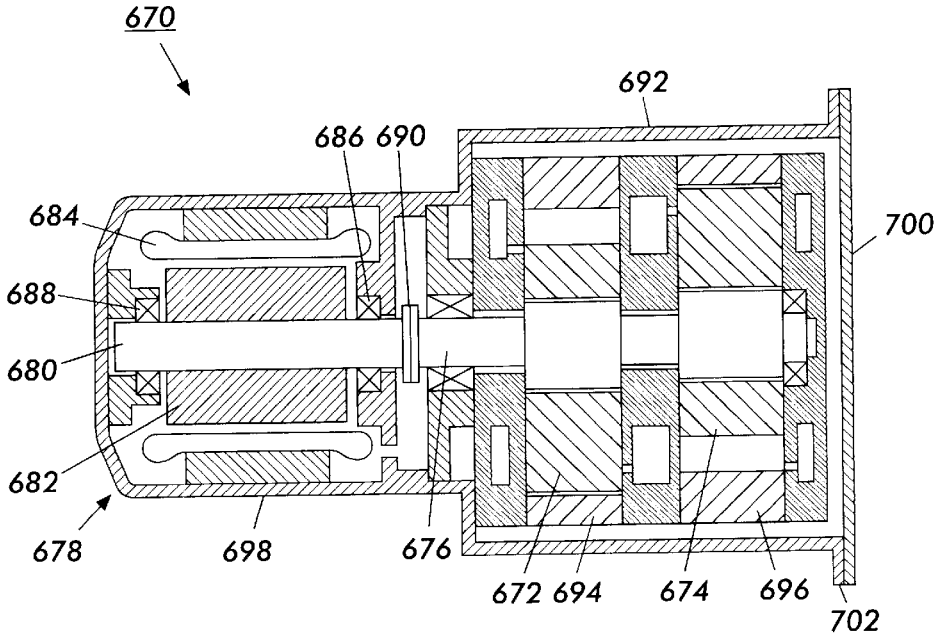
FIG. 19 is a sectional view of a guided rotor assembly with its drive motor enclosed within a hermetic system.

FIG. 19 illustrates an guided rotor assembly 670 comprised of a multiplicity of guided rotors 672 and 674. Shaft 676 is rotated by electric motor 678 which, in the embodiment depicted, is comprised of motor shaft 680, motor rotor 682, and stator 684 supported by bearings 686 and 688. The motor shaft 680 is directly coupled to compressor shaft 676 by means a coupling 690.

The compressor shaft 676 rotates one or more of rotors 672 and 674, which may be of the same size, a different size, of the same function, and/or of a different function.

The motor 678 is cooled by incoming gas (not shown), and such incoming gas is then passed to compressor 692, wherein it is distributed equally to the rotor assemblies 672 and 674, which are disposed within housings 694 and 696, respectively.

In the embodiment depicted in FIG. 19, the rotor assemblies 674 and 676 have substantially the same geometry and capacity. In another embodiment, not shown, the rotor assemblies 674 and 674 have different geometries and/or capacities.

Referring again to FIG. 19, it will be seen that the entire compressor and drive assembly is disposed within hermetic enclosure 698. The end flange 700 is form an interface 702 with enclosure 698 which is a hermetic seal.

Figure 20:
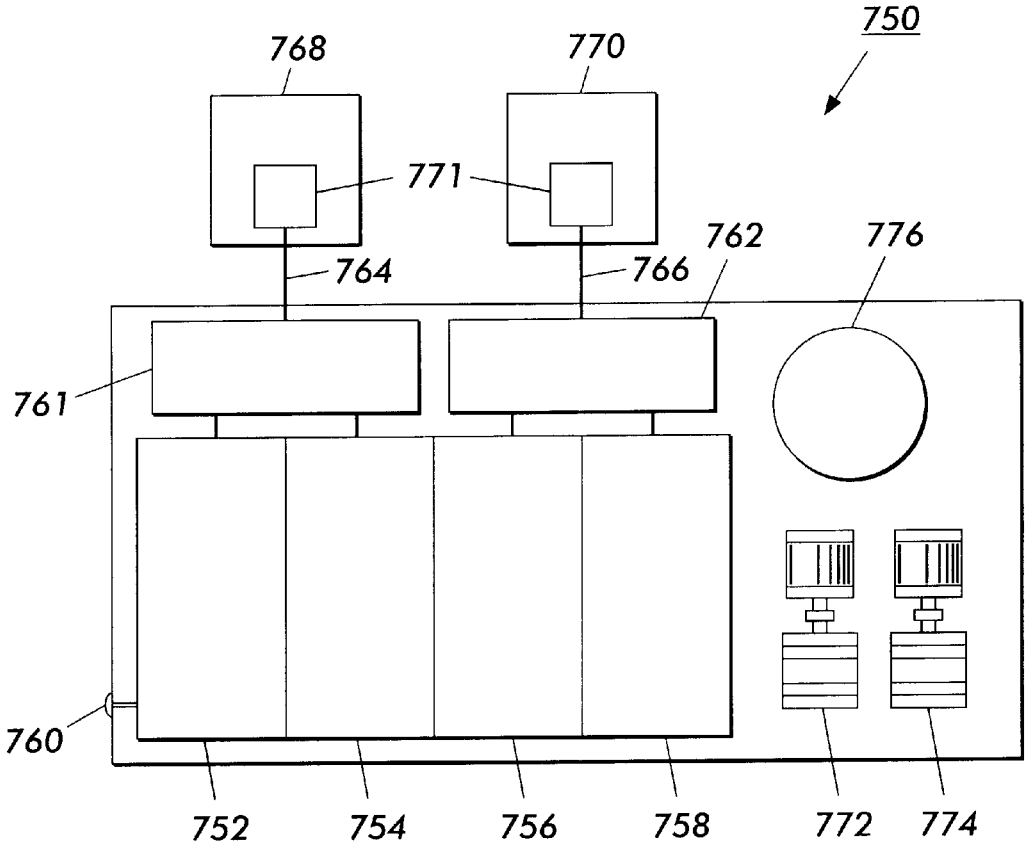
FIG. 20 is a schematic illustration of a microturbine electric generation and waste heat recovery system.

FIG. 20 is a schematic of an assembly 750 for generating electric power and recovering thermal energy for other useful work. Referring to FIG. 20, it will be seen that a multiplicity of micro turbines 752, 754, 756, and 758 are used to generate electricity which, in the embodiment depicted, is fed from the unit at outlet 760.

In one embodiment, a micro turbine such as those sold by the Capstone Turbine Corporation of Woodland Hills, Calif. may be used. Thus, e.g., the Model 330 Capstone Micro Turbine may be used. Thus, e.g., one may use one or more of the micro turbines disclosed in U.S. Pat. Nos. 5,903,116, 5,899,673, 5,850,733, 5,819,524, and the like. The disclosure of each of these United States patents is hereby incorporated by reference into this specification.

Referring again to FIG. 20, the heat discharged from one or more of micro turbines 752, 754, 756, and/or 758 is passed to waste heat boilers 761 and/or 762, wherein the waste heat is used to heat fluid, such as water, and to preferably generate either hot water or steam. The hot fluid from waste heat boilers 761 and/or 762 is then passed via lines 764 and 766 to industrial processes 768 and 770. Any industrial or commercial processes which utilize heat energy may be used in the process. Thus, the waste heat may be used to heat or cool working space, inventory space, etc.; it may be used to heat chemical reagents; it may, in fact, be used in any process which requires heat. Conventional means, such as pipes, heat exchangers, and the like (see, e.g., heat exchanger 771) may be used to extract heat from the heated fluid.

In one embodiment, not shown, the exhaust gases from micro turbines 752, 754, 756, and/or 758 into the air inlet of a combustion boiler, or into any other device which can profitably utilize such hot gasses.

Referring again to FIG. 20, it will be seen that a multiplicity of guided rotor compressors 772 and 774 supply compressed natural gas to the micro turbines 752, 754, 756, and/or 758. Accumulator 776 accumulates compressed gas produced by compressors 772 and/or 774; and, as needed, it also may supply compressed gas to micro turbines 752, 754, 756, and 758.

A Process for Controlling Compressors

Figure 21:
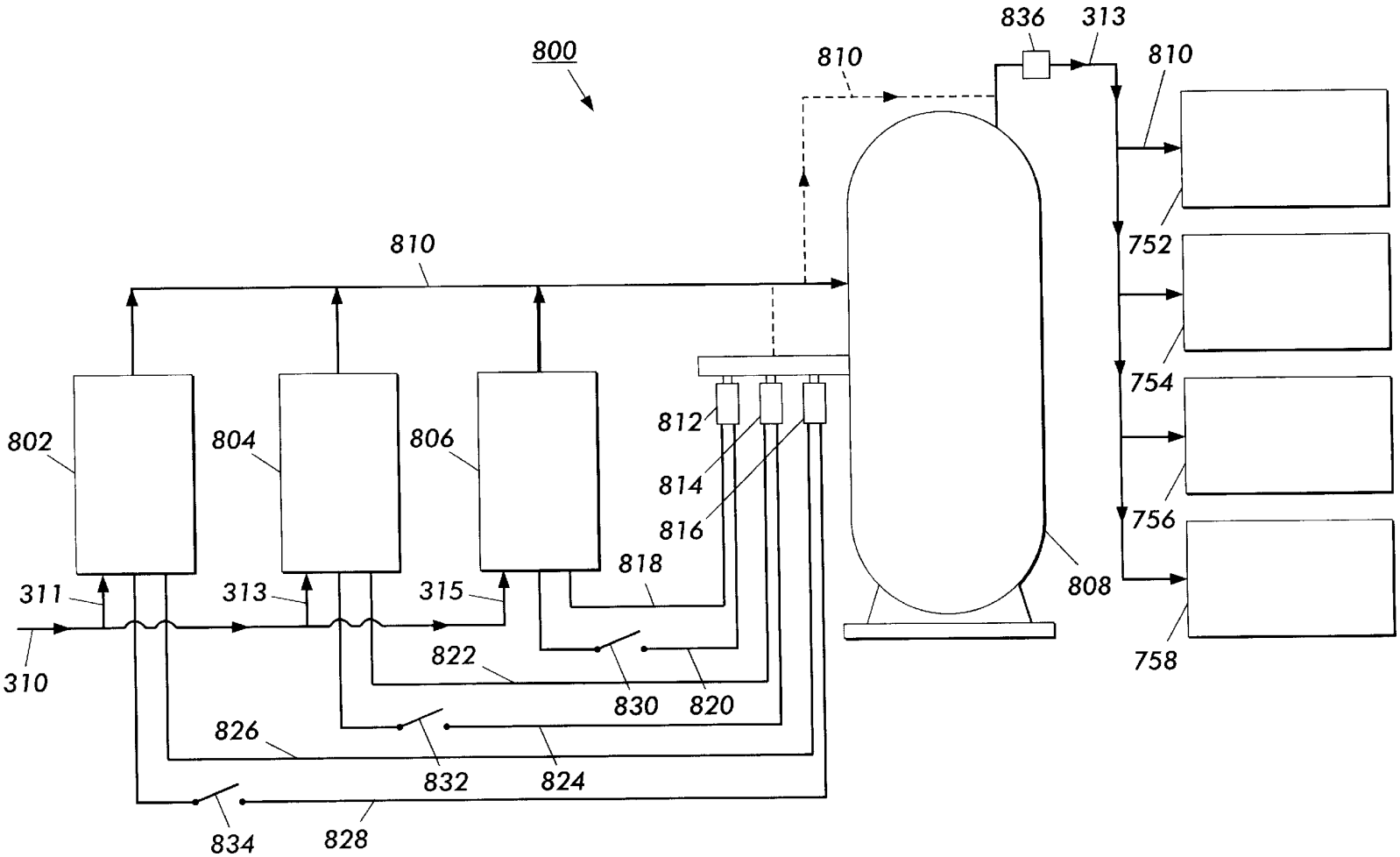
FIG. 21 is a schematic diagram of one preferred process of the invention, illustrating one preferred means for measuring gas pressure within the electrical generating system.

FIG. 21 is a schematic diagram of a system 800 for generating electricity which is comprised of a multiplicity of microturbines 752, 754, 756, and 758 which are described elsewhere in this specification. The system 800 also is comprised of a multiplicity of compressors 802, 804, and 806.

Although four microturbines 752 et seq. are shown in the system depicted in FIG. 21, fewer or more microturbines can be used. It is preferred to use at least two such microturbines in the system 800, but one can use many more in such system such as, e.g., 60 microturbines.

Although three compressors 802 et seq. are shown in the system depicted in FIG. 21, fewer or more such compressors may be used. It is preferred to use at least two such compressors in the system 800, but one can use many more such compressors such as, e.g., 60 compressors.

One may use the guided rotor compressor, described and claimed in U.S. Pat. No. 5,431,551, as one or more of the compressors in system 800. Alternatively, or additionally, one may use one or more of the "hollow roller compressors," described elsewhere in this specification, as one or more of the compressors in system 800. Alternatively, or additionally, one may use other types of compressors such as, e.g., scroll compressors, vane compressors, twin screw compressors, reciprocating compressors, continuous flow compressors, and the like.

Regardless of the compressor, it should be capable of compressing gas to a pressure of from about 40 to about 500 pounds per square inch and of delivering such compressed gas at a flow rate of from about 5 to about 200 standard cubic feet per minute ("scfm"). The term "scfm" is well known to those skilled in the art, and means for measuring it are also well known. See, e.g. U.S. Pat. Nos. 5,672,827, 4,977,921, 5,695,641, 5,664,426, 5,597,491, and the like. The disclosure of each of these United States patents is hereby incorporated by reference into this specification.

Referring to FIG. 21, when system 800 has been shut down and is in the process of just starting up, compressed gas at a pressure of from about 40 to about 500 pounds per square inch is first delivered to microturbine 752.

In the embodiment depicted in FIG. 21, it is preferred to use a pressure regulator 836 in line 313 to insure that gas delivered to microturbine(s) 752 and/or 754 and/or 756 and/or 758 is stable and remains within a specified range of gas pressure.

In the embodiment shown in Figure, reservoir 808 generally will contain a source of compressed gas at a pressure of from about 40 to about 500 pounds per square inch, and this compressed gas may be fed via lines 313 and 810 to microturbine 752.

Reservoir 808 can be any container sufficient for storing and/or dispensing gas at a pressure of from about 40 to about 500 pounds per square inch. Thus, by way of illustration and not limitation, one may use any of the gas storage vessels disclosed in U.S. Pat. Nos. 5,908,134, 5,901,758, 5,826,632, 5,798,156, 5,997,611, and the like. The entire disclosure of each of these United States patents is hereby incorporated by reference into this specification.

In the embodiment depicted in FIG. 21, gas storage vessel 808 acts as the initial supply of compressed gas to microturbine 752. In another embodiment, not shown, gas storage vessel 808 is not used in the system and compressed gas is fed to microturbine 752 from another initial gas source such as, e.g., gas delivery line 810.

Referring again to FIG. 21, after the compressed gas has been delivered to microturbine 752 from either storage vessel 808 and/or line 810, the microturbine starts operation. In the embodiment depicted in FIG. 21, each of microturbines 752, 754, 756, and 758 is comprised of its own controller which, in response to the introduction of gas to such microturbine, starts it in operation. In another embodiment, a central controller operatively connected to each of microturbines 752, 754, 756, and 758, and to each of compressors 802, 804, and 806, is utilized.

Referring again to FIG. 21, each of compressors 802, 804, and 806 is operatively connected to a controller 812, 814, and 816, respectively. In another embodiment, not shown, one controller (not shown) is connected to each of the compressors; this controller might be a computer, a programmable logic controller, etc. In one aspect of this latter embodiment, one controller is operatively connected to each of the compressors, but such unitary controller includes a separate gas pressure sensor device for each such compressor. It is preferred, regardless whether one uses one or more controllers, that each such controller contain a separate gas sensing device for each compressor.

Regardless of which controller or controllers are connected to the compressors 802, 04, and 806, it is preferred that such controllers(s) be comprised of pressure sensing means (not shown) for measuring the pressure of gas. Thus, for example, the pressure sensing means may be pressure switches which combine the function of pressure sensing and electrical switching. Thus, e.g., the pressure sensing means may be pressure transducers adapted to provide a signal to a programmable logic controller.

Regardless of the pressure sensing means used, such means is adapted to determine the pressure within either vessel 808 and/or line 810. When such pressure is outside of a specified desired range of a pressure, but is within the broad pressure range of from about 40 to about 500 pounds per square inch, the pressure sensing means acts as a switch to turn one or more of compressors 802, 804, and/or 806 on or off, depending upon the pressure sensed.

Referring again to FIG. 21, the controllers 812, 814, and 816 are operatively connected to compressors 806, 804, and 802, respectively, by lines 818 and 820, 822 and 824, and 826 and 828, respectively. It should be noted that lines 820, 824, and 828, in one embodiment, preferably comprise a manual switch 830, 832, and 834, respectively to allow one to manually control each of the compressors.

As will be apparent to those skilled in the art, one or more of the manual switches 830, 832, and/or 834 may be used in conjunction with the controllers 812, 814, and 816. When one or more of the controllers 812, 814, and/or 816 are connected in the system 800, the manual switches may be used to disconnect the compressors and negate the effects of the controllers. If the controllers 812, 814, and/or 816 are omitted from system 800, one may manually perform the operations of such controllers by using such switches in response to gas pressure readings may be manual means.

In one embodiment, the controllers 812, 814, and 816 are programmed to turn compressors 802, 804, and 806 on sequentially, in response to the presence of different gas pressure levels within either vessel 808 or line 810. This feature will be illustrated later in the specification by reference to FIG. 23.

Thus, in one typical embodiment, compressor 802 will be turned on when the gas pressure in vessel 808 and/or line 810 is less than, e.g., 60 pounds per square inch; compressors 802, 804, and 806 may be fed gas from gas lines 310, 311, 313, and 315. When this condition occurs, compressor 802 will be switched on and will cause compressed gas to flow to microturbine 752 at a flow rate of, e.g., 7 standard cubic feet per minute.

During the operation of compressor 802, and as long as the gas flow from compressor 802 is sufficient to meet the needs of whichever of microturbines 752, 754, 756, and/or 758 is running, the gas pressure within vessel 808 and line 810 preferably remains at a specified value such as, e.g., 60 pounds per square inch.

After controller 816 has activated compressor 802, when one or more of the sensors in controller 814 senses that the gas pressure within vessel 808 and line 810 has dropped below a desired value, such as, e.g., 55 pounds per square inch, it will then turn on compressor 804 so that it is operating in addition to compressor 802.

Similarly, when compressors 802 and 804 are running, and the sensor in, e.g., controller 812 senses that the gas pressure within vessel 808 and/or line 810 has dropped below a desired value such as, e.g., 50 pounds per square inch, it will turn on compressor 806.

The same process may be used in the reverse order, when one or more of the controllers 812, 814, and 816 sense that the pressure within vessel 808 and/or line 810 exceeds a certain predetermined value. Thus, e.g., compressor 806 may be turned off when the pressure sensed is greater than about, e.g., 65 pounds per square inch, compressor 804 may be turned off when the pressure sensed is greater than about, e.g., 66 pounds per square inch, and compressor 802 may be turned off when the pressure sensed is greater than about 67 pounds per square inch.

As will be apparent to those skilled in the art, other conditions and sequences may be used. What is common to all of the processes, however, is the sequential turning on and/or turning off of a multiplicity of compressors.

Figure 22:
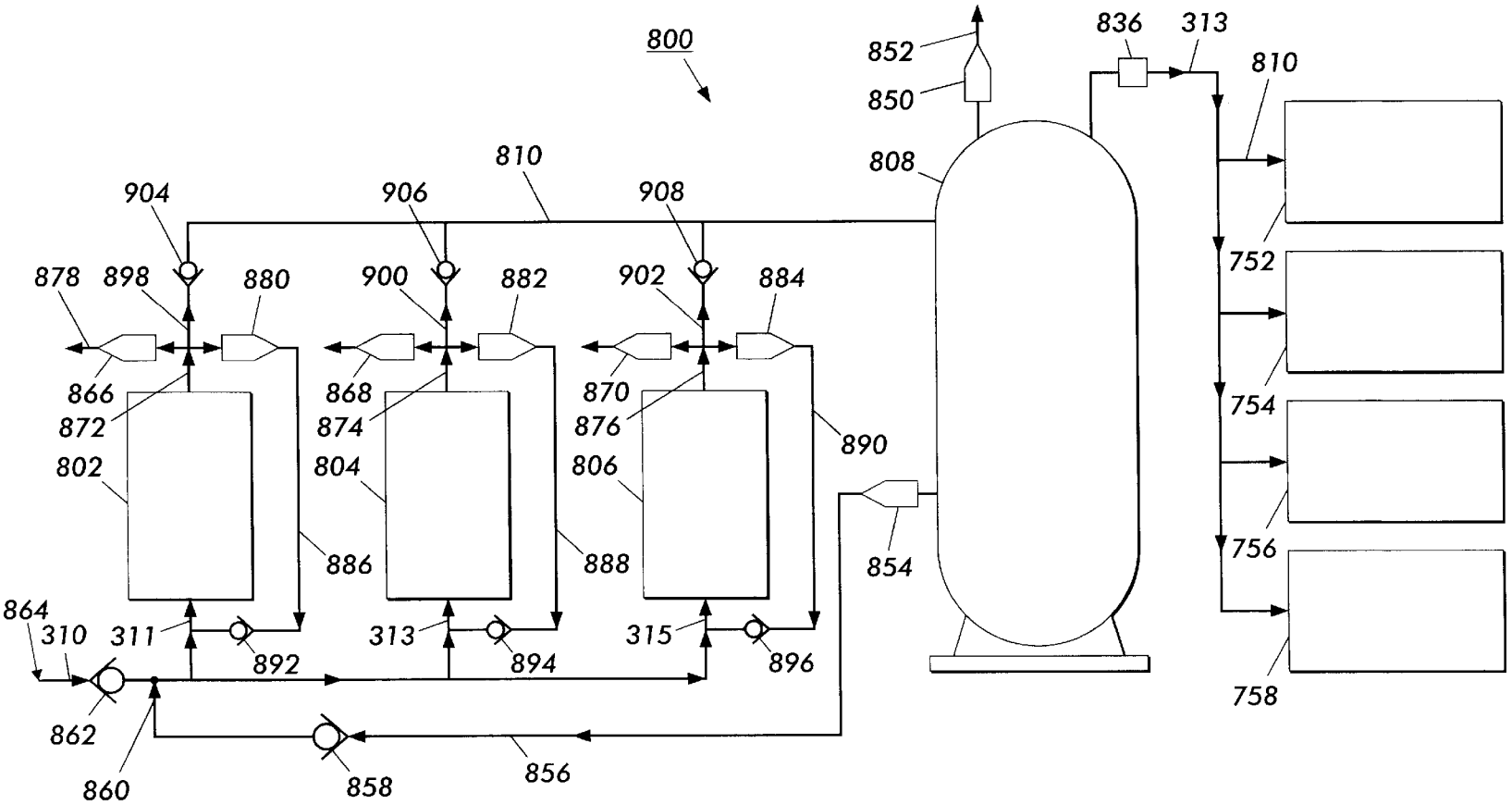
FIG. 22 is a schematic diagram of the process depicted in FIG. 21, illustrating a preferred a preferred pressure relief system.

FIG. 22 illustrates one preferred means of providing pressure relief in an electricity generating system 800.

Referring to FIG. 22, when the pressure within pressure vessel 808 exceeds a specified value, pressure relief valve 850 allows such pressure to vent via line 852 to atmosphere. Thus, e.g., valve 850 can be set to open when, e.g., the pressure within vessel 808 exceeds, e.g., 150 pounds per square inch.

A bypass relief valve 854 is set to open whenever the pressure within vessel 808 exceeds a specified value. In one embodiment, the pressure required to actuate valve 850 is greater than the pressure required to actuate valve 854; if the former pressure, e.g., may 150 pounds per square inch and the latter pressure may be, e.g., 70 pounds per square inch. As will be apparent to those skilled in the art, the actual actuation points for valves 850 and 854 will vary depending upon factors such as the rating of the vessel 808, the power ratings of compressors 802, 804, and 806, the pressures required in the system, etc.

Referring again to FIG. 22, when valve 854 is actuated, gas flows from vessel 808 through line 856 and then through check valve 858 back into line 310 at point 860. Check valve 862 prevents gas recycled into the system at point 860 from flowing back to the original gas supply 864.

Referring again to FIG. 22, and in the preferred embodiment depicted therein, it will be seen that each of compressors 802, 804, and 806 is comprised of a pressure relief valve 866, 868, and 870 which, when the pressure within the compressor discharge 872, 874, and 876 exceeds a certain specified value, gas is vented to the atmosphere 878. Thus, e.g., pressure relief valves 866, 868, and 870 may be designed to actuate at a pressure of, e.g., 150 pounds per square inch.

When the gas pressure at compressor discharge 872, 874, and 876 is less than the pressure required to actuate valves 866, 868 and 870 but is more than another specified value (such as, e.g., 80 pounds per square inch), bypass relief valves 880, 882, and 884 open and flow gas through lines 886, 888, and 890 through check valves 892, 894, and 896 and thence back into lines 311, 313, and 315. In one embodiment, the relief valves 880, 882, and 884 are set to be actuated at levels somewhat lower than the settings in controllers 816, 814, and 812 for turning the compressors off (see FIG. 21).

Referring again to FIG. 22, it will be seen that the gas exiting from compressors 802, 804, and 806 via lines 898, 900, and 902 pass through check valves 904, 906, and 908 which can be used to prevent backflow.

Figure 23:
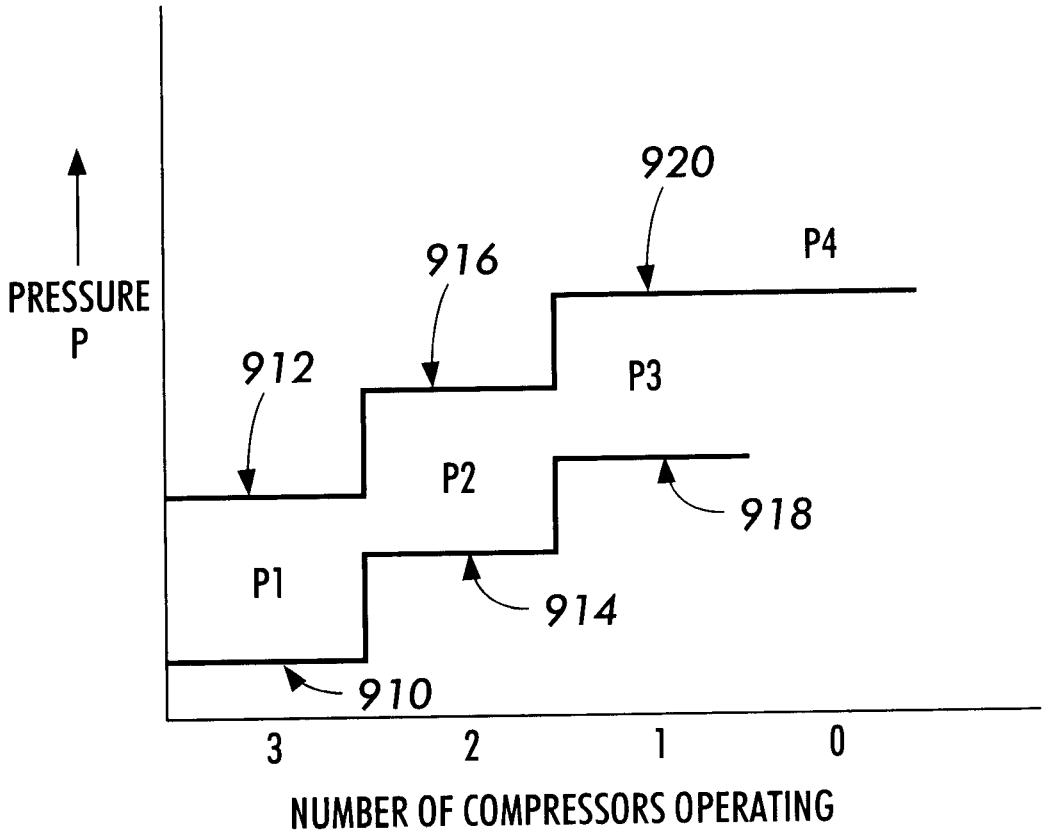
FIG. 23 is a graph illustrating the typical history of gas pressure versus time for the system of FIG. 21.

FIG. 23 is a graph of pressure versus the number of compressors operating, in the system depicted in FIG. 21.

As is illustrated in FIG. 23, the pressure P1, which is within the range defined by points 910 and 912, exists when each of compressors 802, 804, and 806 are operating. The pressure P2, which is within the range defined by points 914 and 916, exists when only compressors 802 and 804 are operating. The pressure P3, which is defined by the points 918 and 920, exists when only compressor 802 is operating. The pressure P4, which is defined by a pressure in excess of the pressure at point 920, exists when the pressure vessel 808 has a pressure outside of the desired range and at least one compressor is operating and producing pressure outside of the desired range, which causes bypass relief valve 854 (see FIG. 21) to open and reduce the pressure at or below level 920.

A Phased Rotary Displacement Device

The instant invention is comprised of an improvement on the structure disclosed in U.S. Pat. No. 5,769,619.

Figure 24:
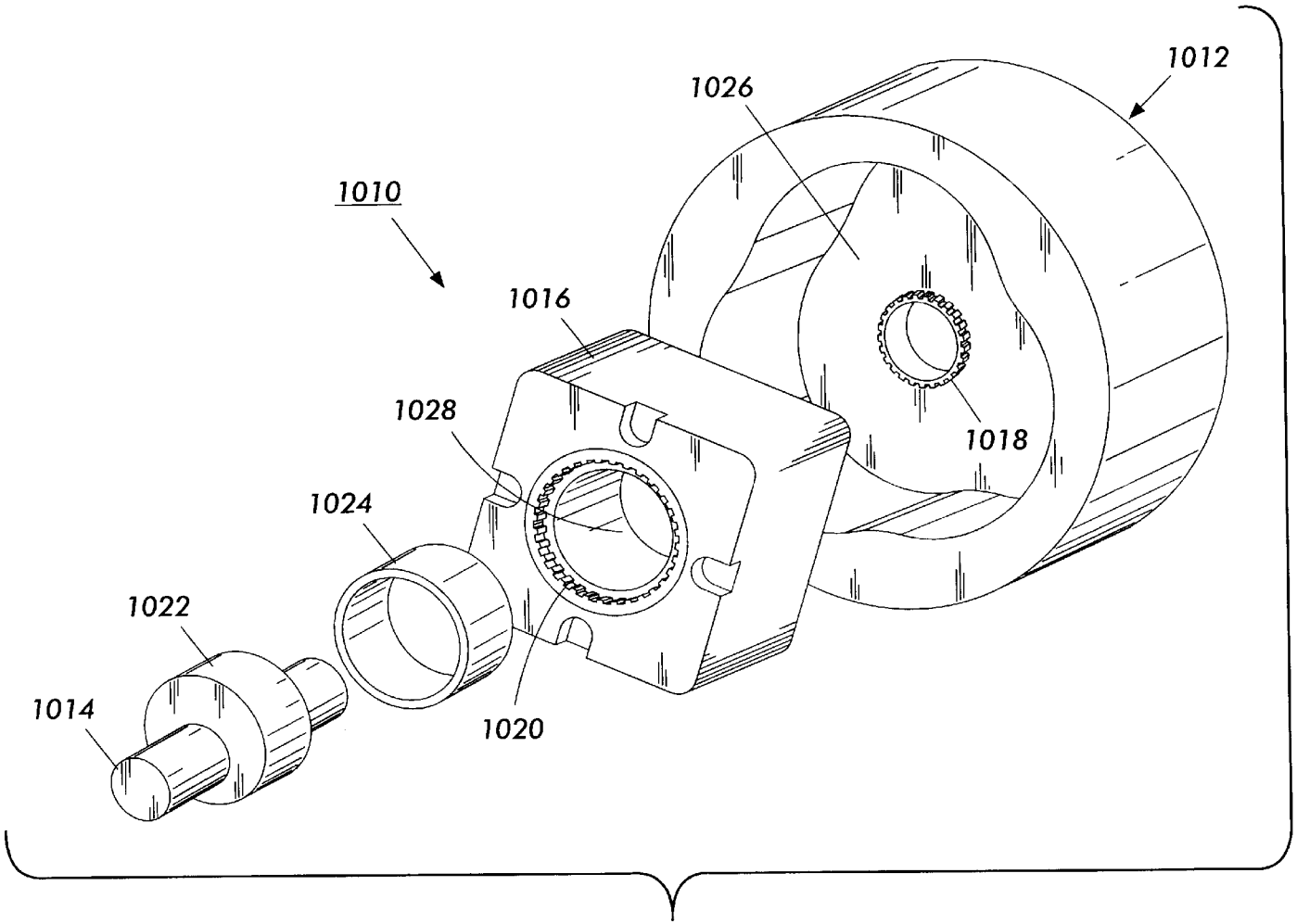
FIG. 24 is an exploded view of one preferred rotary mechanism of the invention.

FIG. 24 is an exploded perspective view of one preferred rotary mechanism 1010. Referring to FIG. 24, it will be seen that rotary mechanism 1010 is comprised of housing 1012, shaft 1014, rotor 1016, external gear 1018, internal gear 1020, eccentric 1022, bearing 1024, and side plate 1026.

Referring again to FIG. 24, it will be seen that housing 1012 is preferably an integral structure. However, housing 1012 may comprise two or more segments joined together by conventional means such as, e.g., bolts.

In one embodiment, housing 1012 consists essentially of steel. As is known to those skilled in the art, steel is an alloy of iron and from about 0.02 to about 1.5 weight percent of carbon; it is made from molten pig iron by oxidizing out the excess carbon and other impurities (see, e.g., pages 23–14 to 23–56 of Robert H. Perry et al's "Chemical Engineer's Handbook," Fifth Edition (McGraw-Hill Book Company, New York, N.Y., 1973).

In another embodiment, housing 1012 consists essentially of aluminum. In yet another embodiment, housing 1012 consists essentially of plastic. These and other suitable materials are described in George S. Brady et al.'s "Materials Handbook," Thirteenth Edition (McGraw-Hill, Inc., New York, N.Y., 1991).

In another embodiment, housing 1012 consists essentially of ceramic material such as, e.g., silicon carbide, silicon nitride, etc.

In one embodiment, housing 1012 is coated with a wear-resistant coating such as, e.g., a coating of alumina formed electrolytically, electroless nickel, tungsten carbide, etc.

One advantage of applicant's rotary mechanism 1010 is that the housing need not be constructed of expensive alloys which are resistant to wear; and the inner surface of the housing need not be treated with one or more special coatings to minimize such wear. Thus, applicants' device is substantially less expensive to produce than prior art devices.

Housing 1012 may be produced from steel stock (such as, e.g., C1040 steel stock) by conventional milling techniques. Thus, by way of illustration, one may use a computer numerical controlled milling machine which is adapted to cut a housing 1012 with the desired curved surface.

Similarly, the rotor 1016 may be made of any material(s) from which the housing 1012 is made.

Referring again to FIG. 24, and in the preferred embodiment depicted therein it will be seen that housing 1012 is comprised of an external gear 1018 mounted on an inner wall 1026 of such housing 1012. The external gear 1018 is so disposed that, when drive shaft 1014 is disposed therein, the gear 1018 is concentric to the drive shaft 1014.

The external gear 1018 preferably has a substantially circular cross-sectional shape.

In order for the external gear 1018 and the internal gear 1020 to phase properly the rotor 1016 in the housing 1012, they have to meet two different conditions. In the first place, the difference between the two pitch diameters of the internal and external gears must be exactly twice the eccentricity of the shaft 1022. In the second place, the ratio between the pitch diameters of the internal and external gears must be the same as the ratio between the numbers of sides in rotor 1016 divided by the number of lobes in housing 1012. These criteria will be discussed in more detail later in this specification.

The eccentricity of eccentric 1022 generally will be from about 0.05 to about 10 inches. It is preferred that the eccentricity be from about 0.15 to about 1.5 inches.

Referring again to FIG. 24, and in the preferred embodiment depicted therein, it will be seen that bearing 1024 can either be a sleeve bearing and/or a rolling element bearing.

Figure 25:
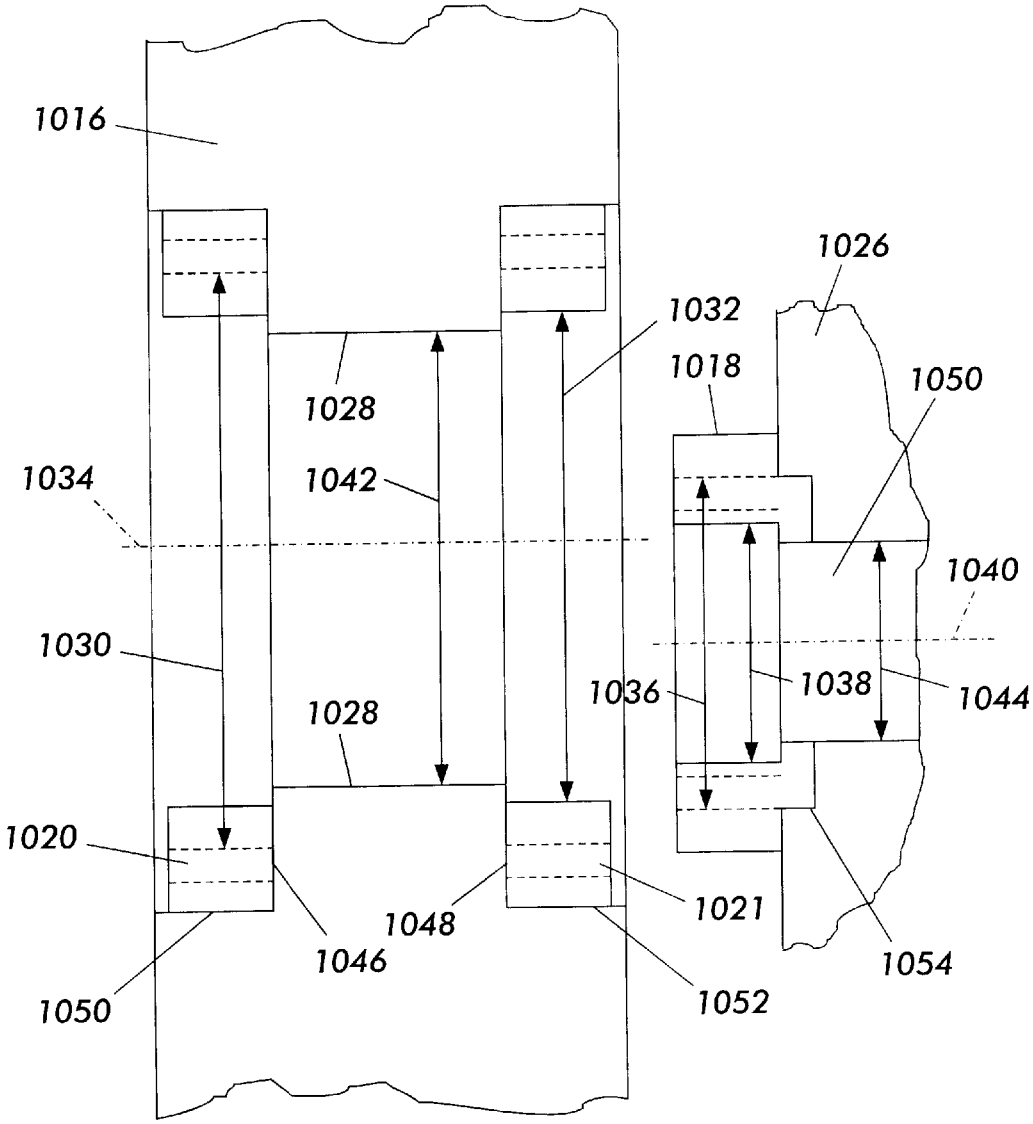
FIG. 25 is a partial sectional view of the mechanism of FIG. 24, illustrating the interaction between the rotor and external gear on the side plate of the housing.

Referring to FIG. 25, it will be seen that rotor 1016 is comprised of a bore 1028 with a center line 1034 and an internal diameter 1042. The internal diameter 1042 of bore 1028 is smaller than the pitch diameter 1030 of internal gear 1020.

As is known to those skilled in the art, the term pitch diameter refers to the diameter of an imaginary circle, which commonly is referred to as the "pitch circle," concentric with the gear axis 1034, which rolls without slippage with a pitch circle of a mating gear. Reference may be had, e.g., to U.S. Pat. Nos. 5,816,788, 5,813,488, 5,704,865, 5,685,269, 5,474,503, 5,454,175, 5,387,000, and the like. The disclosure of each of these United States patents is hereby incorporated by reference into this specification.

Referring again to FIG. 25, it will be seen internal diameter 1042 is also smaller than diameter 1032 of the addendum circle of internal gear 1020. As is known to those skilled in the art, the addendum circle is a circle on a gear passing through the tops of the gear teeth. See, e.g., U.S. Pat. Nos. 5,438,732, 5,154,475, 5,090,771, 4,864,893, 4,813,853, 4,780,070, and the like. The entire disclosure of each of these United States patents is hereby incorporated by reference into this specification.

Referring again to FIG. 25, it will be seen that two internal gears 1020 and 1021 are depicted, one of which is disposed at end 1046 of the rotor 1016, and the other which is disposed at end 1048 of rotor 1016. In the preferred embodiment depicted, each of gears 1020 and 1021 is disposed within a counterbore (1050 and 1052, respectively). In another embodiment, not shown, only one gear 1020 or 1021 is disposed on one side of rotor 1016.

The gears 1020,1021 may be attached to rotor 1016 by conventional means such as, e.g., by mechanical means (using fasteners such as bolts, internal retaining rings, etc.), by interference fit, by electron beam welding, etc.

In the embodiment depicted in FIG. 24, the rotor 1016 contains four sides and has a substantially square shape. As will be apparent to those skilled in the art, one may use rotors with 3 sides (not shown), 5 sides, 6 sides, etc. In general, it is preferred the rotor contain at least 3 sides and no more 6 sides.

Referring again to FIG. 25, it will be seen that an external gear 1018 is disposed within side plate 1026 and, more precisely, within counterbore 1054 of side plate 1026. In the embodiment depicted, only one such external gear 1018 is shown disposed on one side plate. In another embodiment, not shown, two such external gears are used and are disposed on both sides of rotor 1016. It will be apparent that, although only one side plate 1026 is shown in FIGS. 24 and 25 for the sake of simplicity of representation, at least two such side plates generally are required for each housing, one for each side of the housing.

Referring again to FIG. 25, it will be seen that side plate 1026 is comprised of a bore 1050 with a centerline 1040 and an internal diameter 1044. The internal diameter 1044 of bore 1050 is smaller than the pitch diameter 1036 of external gear 1018.

It will be seen that internal diameter 1044 is also smaller than the diameter 1038 of the external gear 1018, which is the inner bore of external gear 1018.

The gear(s) 1018 may be attached to side plate 1026 by conventional means such as, e.g., by mechanical means (using fasteners such as bolts, internal retaining rings, etc.), by interference fit, by electron beam welding, etc.

As mentioned elsewhere in this specification, in order for the external gear 1018 and the internal gear 1020 to phase properly the rotor 1016 in the housing 1012, two different conditions must be met. In the first place, the difference between the two pitch diameters of the internal and external gears (viz., pitch diameters 1030, and 1036) must be exactly twice the eccentricity of the shaft 1022. In the second place, the ratio between the pitch diameters 1030 and 1036 of the internal and external gears must be the same as the ratio between the numbers of in rotor 1016 divided by the number of lobes in housing 1012.

Figure 26:
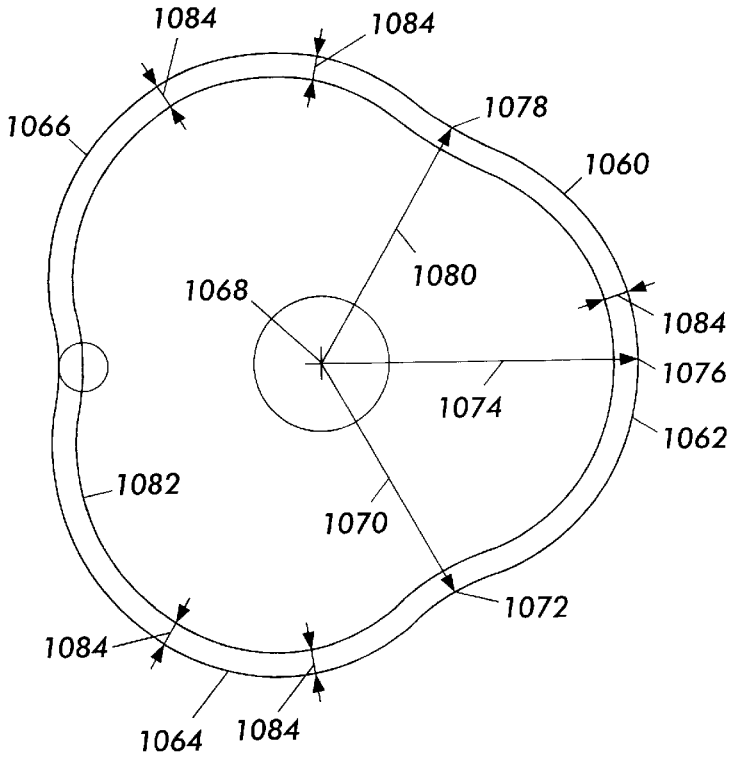
FIG. 26 is a schematic representation of a troichoidal surface and an envoluted trochoidal surface produced by the device of this invention.

FIG. 26 is a schematic representation of trochoidal surface 1082 and envoluted trochoidal surface 1060 referred to in this specification. Referring to FIG. 26, and in the preferred embodiment depicted therein, it will be seen that surface 1060 defines a multiplicity of lobes 1062, 1064, and 1066 which, in combination, define an inner surface 1060 which has a continuously changing curvature.

Referring again to FIG. 26, it will be seen that, with regard to lobe 1062, the distance from the centerpoint 1068 to any one point on lobe 1062 will preferably differ from the distance from the centerpoint to an adjacent point on lobe 1062; both the curvature and the distance from the centerpoint 1068 is preferably continuously varying in this lobe (and the other lobes). Thus, for example, the distance 1070 between point 1068 and 1072 is preferably substantially less than the distance 1074 between points 1068 and 1076; as one progresses from point 1012 to point 107 around surface 1060, such distance preferably continuously increases as the curvature of lobe 1062 continuously changes. Thereafter, as one progresses from point 1076 to point 1078, the distance 1080 between point 1068 and point 1078 preferably continuously decreases.

Referring again to FIG. 26, it will be apparent to those skilled in the art that, in this preferred embodiment, the same situation also applies with lobes 1066 and 1064. Each of such lobes is preferably defined by a continuously changing curved surface; and the distance from the centerpoint 1068 is preferably continuously changing between adjacent points.

In the preferred embodiment illustrated in FIG. 26, it is preferred to have at least two of such lobes 1062, 1064, and 1066. It is more preferred to have at least three of such lobes. In another embodiment, at least four of such lobes are present.

It is preferred that each lobe present in the inner surface 1060 have substantially the same curvature and shape as each of the other lobes present in inner surface 1060. Thus, referring to FIG. 26, lobes 1062, 106, and 1066 are displaced equidistantly around centerpoint 1068 and have substantially the same curvature as each other.

The curved surface 1060 may be generated by conventional machining procedures. Thus, as is disclosed in U.S. Pat. No. 4,395,206, the designations "epitrochoid" and "hypotrochoid" surfaces refer to the manner in which a trochoid machine's profile curves are generated; see, e.g., U.S. Pat. No. 3,117,561, the entire disclosure of which is hereby incorporated by reference into this specification.

An epitrochoidal curve is formed by first selecting a base circle and a generating circle having a diameter greater than that of the base circle. The base circle is placed within the generating circle so that the generating circle is able to roll along the circumference of the base circle. The epitrochoidal curve is defined by the locus of points traced by the tip of the radially extending generating or drawing arm, fixed to the generating circle having its inner end pinned to the generating circle center, as the generating circle is rolled about the circumference of the base circle (which is fixed).

Figure 29:
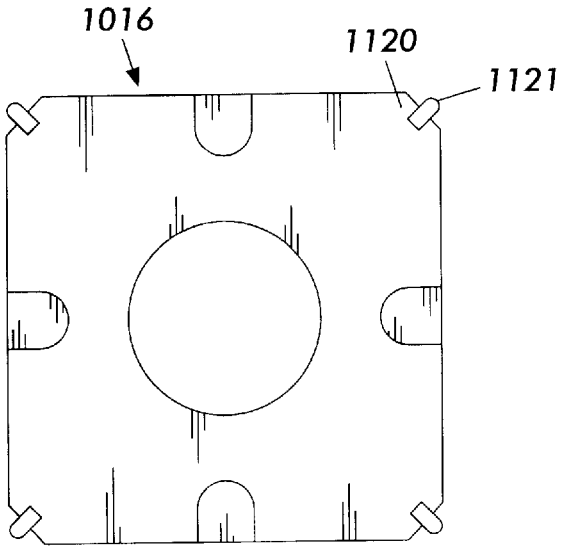

In one embodiment, the epitrochoidal curve is generated in accordance with the procedure illustrated in FIG. 29 of U.S. Pat. No. 5,431,551, the entire disclosure of which is hereby incorporated by reference into this specification.

Figure 4:
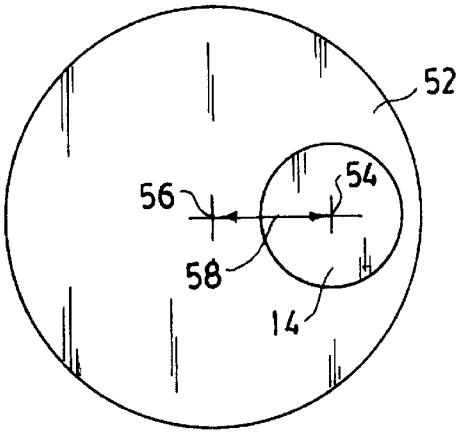
FIG. 4 PRIOR ART
FIG. 4A is a transverse, cross-sectional view of the eccentric crank of FIG. 3.
Figure 4A:
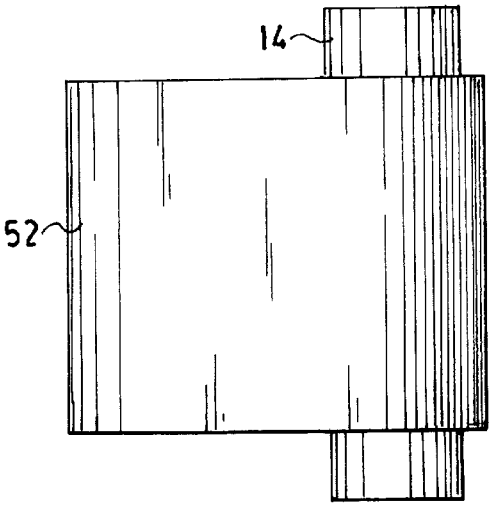
FIG. 4A PRIOR ART
Figure 5:
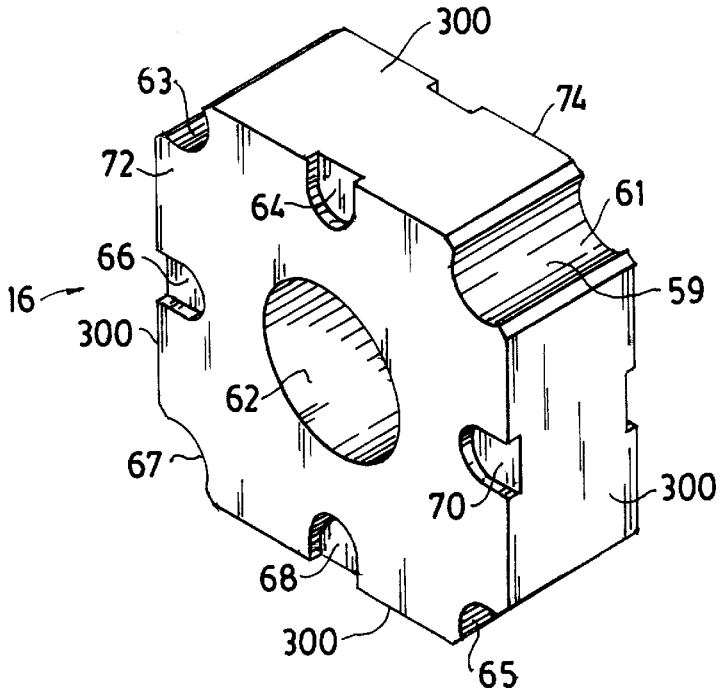
FIG. 5 PRIOR ART
FIG. 5 is a perspective view of the rotor of the device of FIG. 1.
Figure 7:
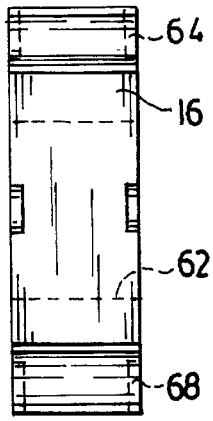
FIG. 7 PRIOR ART
FIG. 7 is a transverse, cross-sectional view of the rotor of FIG. 5.

As is disclosed on lines 36 to 55 of column 5 of U.S. Pat. No. 4,395,206, it is common practice to recess or carve out the corresponding profile of the epitrochoid member a distance "x" equal to the outward offset of the apex seal radius (see FIG. 4 of such patent). As is stated on lines 48 et seq. in such patent, in " . . . the case of an inner envelope type device 20', as shown in FIG. 4, such carving out requires that the actual peripheral wall surface profile 33 which defines the cavity 34 of the housing 35 be everywhere radially outwardly recessed from the ideal epitrochoid profile 36. In the case of an outer envelope device 21', as illustrated in FIG. 5, such carving out requires that the actual peripheral face profile of the epitrochoid working member, rotor 38, be everywhere inwardly radially recessed from the ideal epitrochoid profile 39."

Referring again to FIG. 26, it will be seen that applicants' inner housing surface profile 1060 is generated from ideal epitrochoid curve 1082 and is outwardly recessed from ideal curve 1082 by a uniform distance 1084. In one preferred embodiment, uniform distance 1084 is a function of the eccentricity of the eccentric 1022 used in device 1010 (see FIG. 24).

Referring again to FIG. 24, it will be seen that rotary mechanism 1010 is comprised of a shaft 1014 on which the eccentric 1022 is mounted. Shaft 1014 preferably has a circular cross-section and is cylindrical in shape. Shaft 1014 is connected to eccentric 1022. In one embodiment, illustrated in FIG. 24, shaft 1014 and eccentric 1022 are integrally formed and connected.

In one preferred embodiment, both shaft 1014 and eccentric 1022 consist essentially of steel such as, e.g., carbon steel which contains from about 0.4 to about 0.6 weight percent of carbon.

FIG. 4 of U.S. Pat. No. 5,431,551 is a front view of the shaft/eccentric assembly of this patent, and discussion is presented in such patent of the eccentricity of such assembly. As is known to those skilled in the art, eccentricity is the distance of the geometric center of a revolving body (eccentric 22) from the axis of rotation.

Referring again to FIG. 26, and in the preferred embodiment illustrated therein, it is preferred that the distance 1084 be from about 0.5 to about 5.0 times as great as the eccentricity of eccentric 1022 (see FIG. 24). In a more preferred embodiment, the distance 1084 is from about 1.0 to about 2.0 times as great as the eccentricity. In one embodiment, distance 1084 is about 0 times as great as the eccentricity.

FIG. 29 is a perspective view of a rotor assembly 1010 in which the apices 1086, 1088, 1090, and 1092 are not directly contiguous with the inner surface 1056 of housing 1012. In this embodiment, inner surface 1056 defines a theoretical trochoidal shape 1082 (see FIG. 28).

Figure 6:
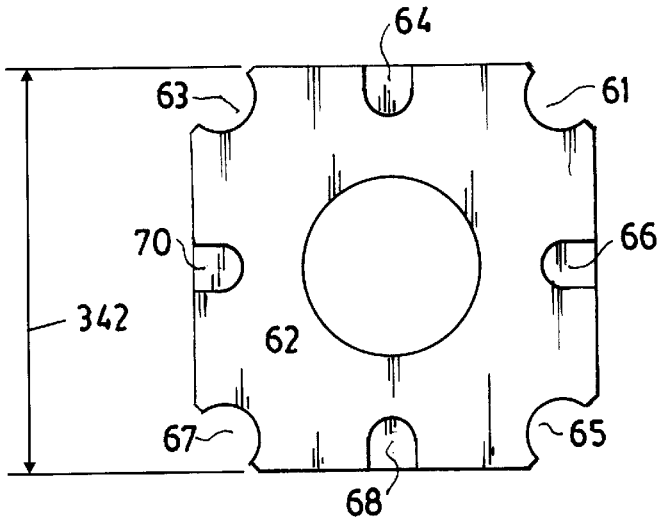
FIG. 6 PRIOR ART
FIG. 6 is an axial, cross-sectional view of the rotor of FIG. 5.
Figure 8:
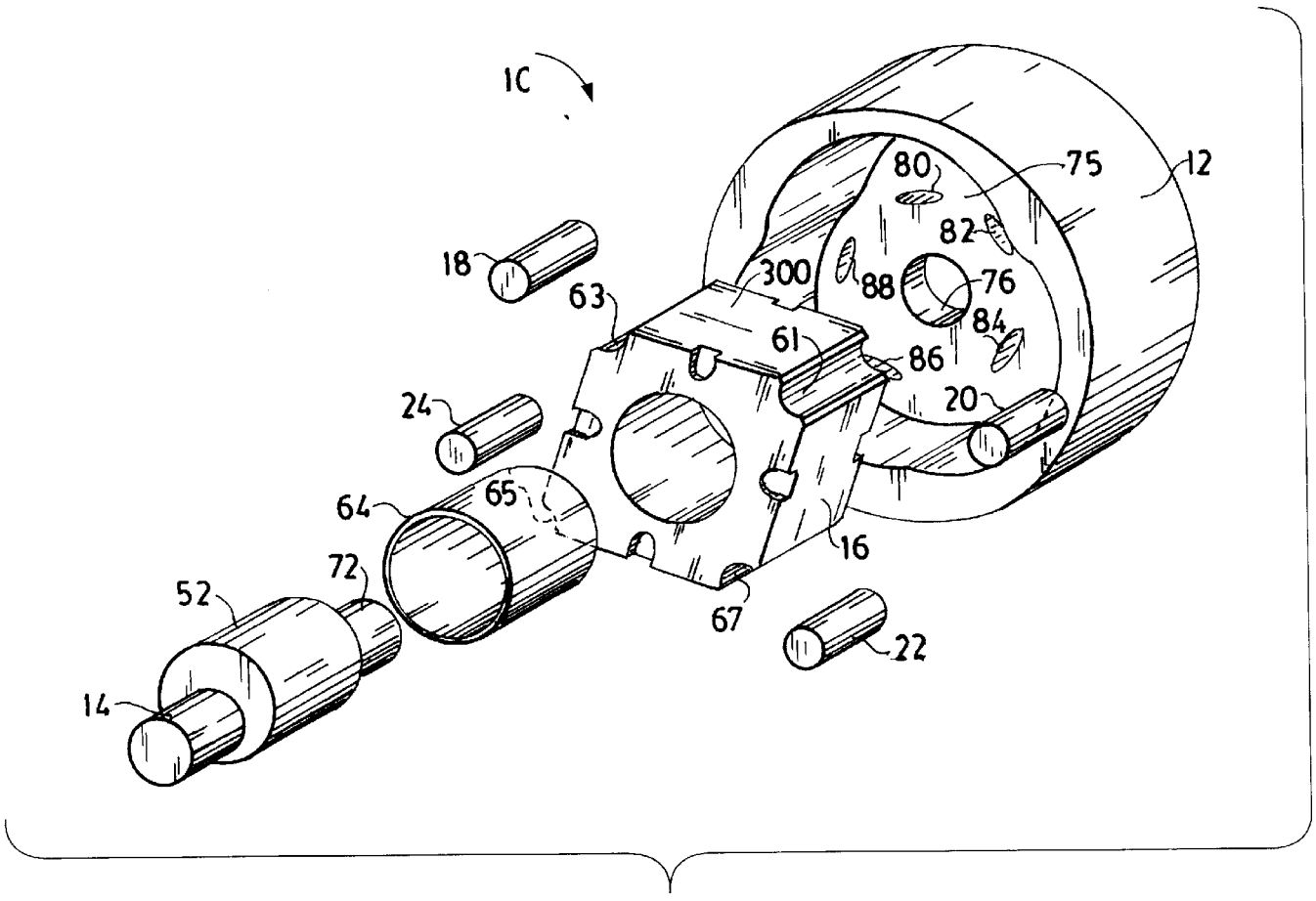
FIG. 8 PRIOR ART
FIG. 8 is an exploded, perspective view of the device of FIG. 1.

The apparatus 1010 may comprise one or more of apex seals disclosed in FIG. 6 of U.S. Pat. No. 5,769,619, the entire disclosure of which is hereby incorporated by reference into this specification. Thus, FIGS. 4, 5, 6, 7, and 8 depict rotor(s) 16 with different types of sealing surfaces on each of its apices. In these Figures, for the sake of simplicity of representation, the external gear(s) 18 has been omitted.

Figure 28:
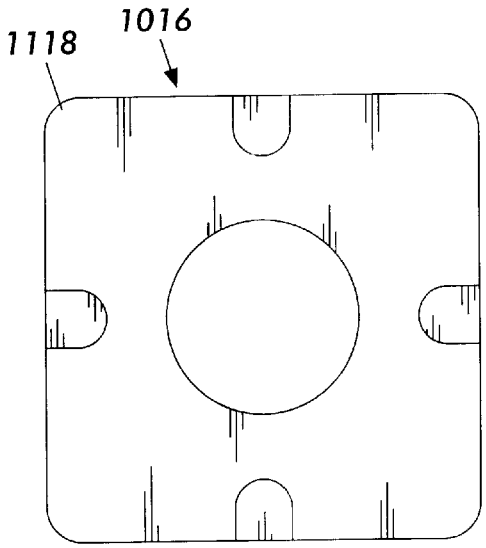

Referring to FIG. 28, it will be seen that apex 1118 is preferably a solid curved surface which is made from the same material as is rotor 116. In this embodiment, the apex 1118 is non-compliant, it provides close-clearance sealing at a distance of from about 0.0001 to about 0.002 inches from the inner surface of the housing (not shown), and it will describe an envoluted trochoidal geometry during its operation.

Referring to FIG. 26, apex 1120 is connected to an apex seal 1121. In the embodiment depicted, apex seal 1121 is a linear strip seal which is disposed within rotor 116. Linear strip seal 1121 can be metallic or non-metallic.

In one embodiment, where apex seal 1121 is a fixed strip of material, it provides close-clearance sealing at a distance of from about 0.001 to about 0.002 inches away from the inner surface of the housing and describes an ideal trochoidal geometry during its operation. In another embodiment, where the seal 1121 is made compliant by conventional means, it provides substantially zero clearance sealing and also describes an ideal trochoidal geometry during its operation.

Figure 30:
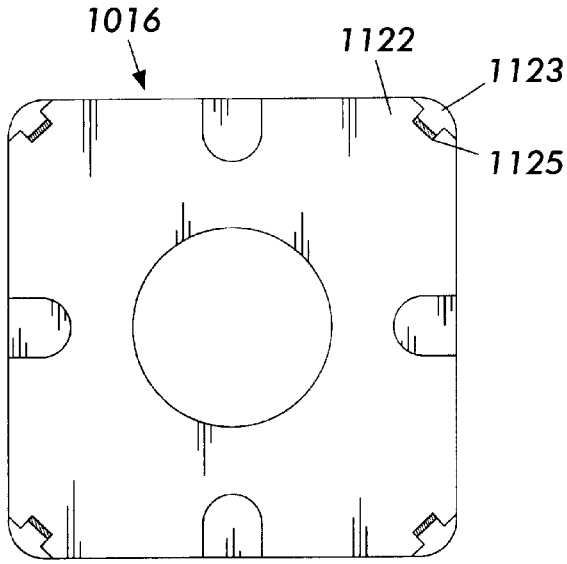

Referring to FIG. 30, apex 1122 is comprised of a separate curved surface 1123 affixed to apex 1122 and made complaint by virtue of the presence of spring 1125. In this embodiment, the apex 1122 provides substantially 0 clearance sealing and describes an envoluted trochoidal geometry during its operation. The surface 1123 may consist of an ultra-high molecular weight plastic.

Figure 31:
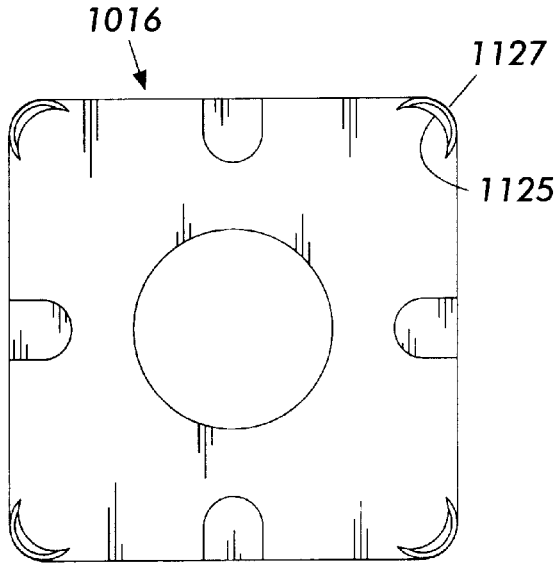

Referring to FIG. 31, apex 1124 is comprised of a separate curved surface 1127 which is formed from a strip of material pressed into a recess (not shown) in rotor 116. If this curved surface 1127 is made from compliant material, apex 1124 will also be compliant during operation, thereby providing substantially zero clearance, and will describe an envoluted trochoidal geometry during its operation. A port (not shown) communicating with the pressurized portion of a pressurized volume (not shown) may be employed to pressurize the back the curved surface 1127, such that improved clearance control is achieved at higher pressures. In a similar manner, an equalizing pressure can also be applied to linear strip seal 1121 (see FIG. 29) and/or surface 1123 (see FIG. 30).

Figure 27:
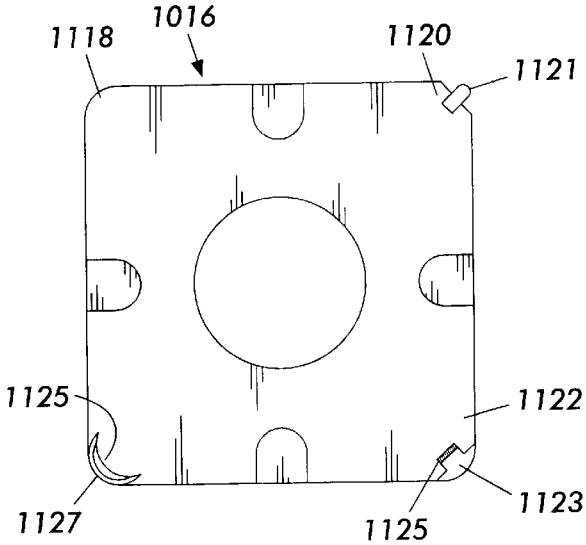
FIGS. 27, 28, 29, 30, and 31 are schematic representations of a rotor with a solid curved surface, a strip seal, a spring-loaded seal, and a strip of material, as well as all of these structures, disposed at one or more of its apices for sealing purposes.

FIG. 27 illustrates an embodiment in which each of the different apex sealing means described above exist with reference to one particular rotor 1016. It will be apparent that other combinations of sealing means besides the ones depicted also may be used.

A Landfill Power Generation System

Figure 32:
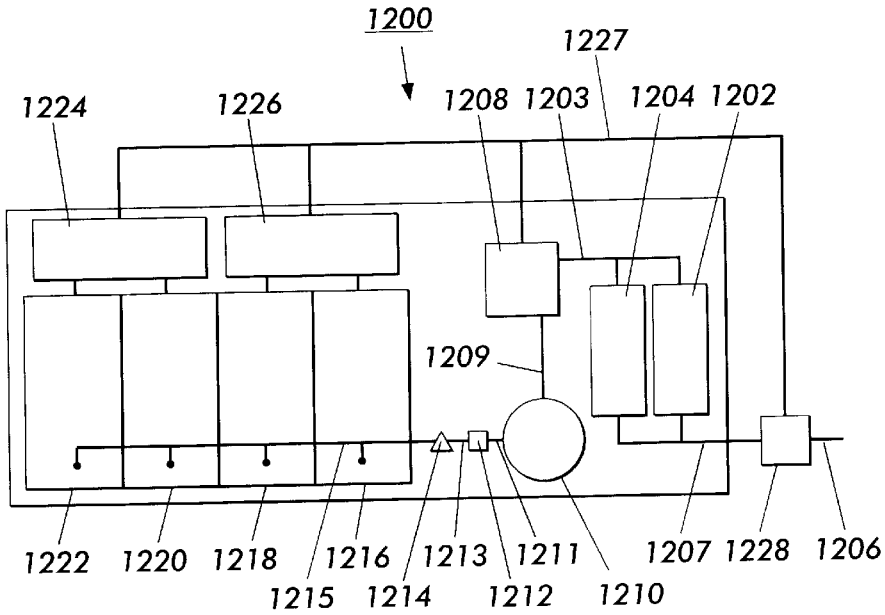
FIG. 32 is a schematic representation of a process for generating electricity from landfill gas.

FIG. 32 is a schematic representation of a landfill power generation system 1200 which is comprised of compressor 1202, compressor 1204, landfill gas inlet 1206, cooler 1208, accumulator/separator 1210, coalescent filter 1212, pressure regulator 1214, microturbine 1216, microturbine 1218, microturbine 1220, microtrubine 1222, waste heat boiler 1224, and waste heat boiler 1226.

In the operation of the process depicted in FIG. 32, landfill gas is introduced from line 1206. The landfill gas may be derived from any landfill source by well known means. Thus, e.g., one may use any of the landfill gases described in U.S. Pat. Nos. 6,092,364, 6,090,312, 6,082,133, 6,080,226, 6,071,326, 6,061,637, 6,051,518, and the like. The entire disclosure of each of these United States patents is hereby incorporated by reference into this specification.

Referring again to FIG. 32, the landfill gas introduced via line 1206 may optionally be fed to a dehumidifier 1228 in which the moisture level of the gas reduced to a dew point temperature of at least 20 degrees Fahrenheit less than the temperature of the untreated gas. One may use any conventional gas dehumidification device incorporating either a vapor compression cycle and/or an absorption cycle. Alternatively, one may use a chilled medium (such as water) produced in another process. Additionally, one may use a conventional radiator.

The gas introduced via line 1206, which may optionally be dehumidified, is fed via line 1207 to one or more gas booster systems 1202, 1204, etc. The gas booster systems preferably a comprise a compressor and auxiliary systems such as lubrication systems, drive systems, cooling systems, etc. See the discussion of such systems which appears elsewhere in this specification.

For redundancy reasons, it is preferred to use at least two of such gas booster systems 1202 et seq.

The compressed gas from booster systems 1202 et seq. is then fed via line 1203 to optional cooler which, preferably, reduces the temperature of the gas stream by at least about 10 degrees Fahrenheit. The gas stream often contains a mixture of gas and oil; the oil is often introduced by the booster systems 1202 et seq.

The gas from cooler 1208 is then passed via line 1209 to an accumulator/separator 1210 which is described elsewhere in this specification. The accumulator/separator 1210 removes oil from the gas stream. Although only one accumulator/separator is shown in FIG. 32, more than one such accumulator/separator may be used. In one embodiment, two or more such accumulator/separators are used.

The gas from accumulator/separator(s) 1210 is then fed via line 1211 to one or more coalescent filters 1212, which mechanically remove liquid from the gas stream. The coalescent filters are well known and are described, e.g., in U.S. Pat. Nos. 4,562,791, 4,822,387, 4,957,516, 5,001,908, 5,131,929, 5,306,331, and the like. The disclosure of each of these United States patents is hereby incorporated by reference into this specification.

The filtered gas is then fed via line 1213 to a pressure regulator 1214, which reduces the pressure of the filtered gas to the particular pressure required by the microturbine. Thus, e.g., Capstone model 330 microturbines requires fuel pressure at from 50 to 55 p.s.i.g.

The depressurized gas is then fed via line 1215 to one or more of microturbines 1215, 1218, 1220, and 1222. Although four microturbines are illustrated in FIG. 32, fewer (as few as one) or more such microturbines may be used.

The exhaust heat produced by the microturbines may optionally be fed to waste heat recovery systems 1224 and 1226. One may use any conventional waste heat recovery system in this process such as, e.g., the waste heat recovery systems disclosed in U.S. Pat. Nos. 4,911,110, 4,911,359, 4,934,286, 4,936,869, 4,981,676, 4,982,511, and the like. The entire disclosure of each of these United States patents is hereby incorporated by reference into this specification. Alternatively, or additionally, the heat from waste heat recovery systems 1224/1226 may be fed via line 1227 to provide the heat energy for absorption cycle utilized cooler 1208 and/or dehumidifier 1228. In one embodiment, the dehumdifier 1228 utilizes one or more dessicants.

Figure 33:
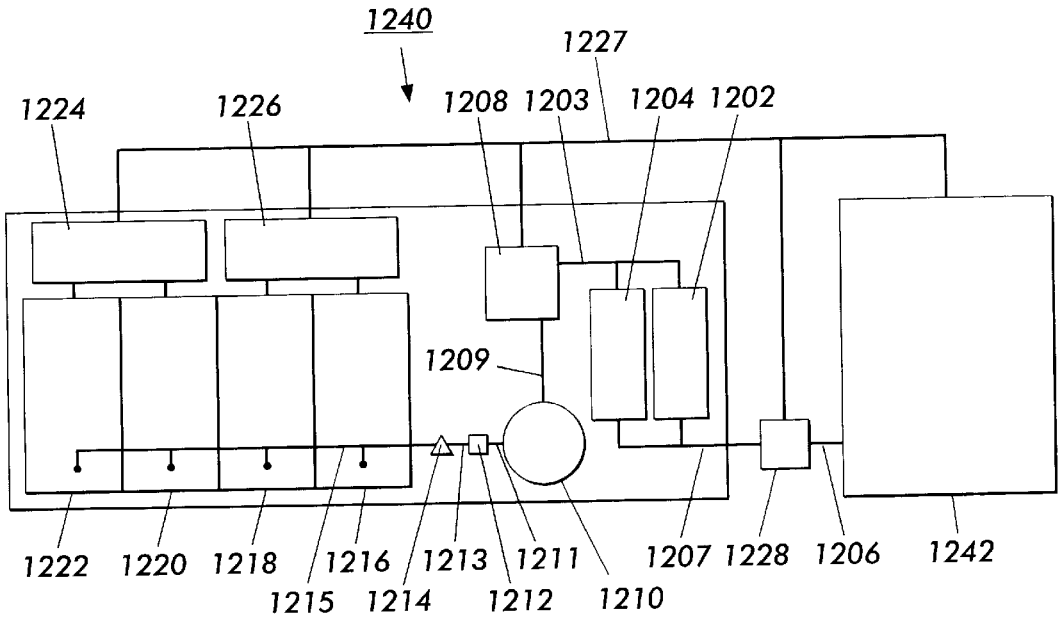
FIG. 33 is a schematic representation of another process for generating electricity from digester gas.

FIG. 33 is a schematic representation of another electricity generation system 1240 which preferably runs on digester gas. System 1240 is similar in some respects to system 1227 but differs therefrom in containing a digester system 1242 which produces gas from organic waste or biomass. Thus, one may use any of the digesters known to those skilled in the art such as, e.g., those describe in U.S. Pat. No. 4,274,838 (anaerobic digester for organic waste), U.S. Pat. No. 4,289,625 (hybrid bio-thermal gasification), U.S. Pat. No. 4,316,961 (methane production by anaerobic digestion of plant material and organic waste), U.S. Pat. No. 4,378,437 (digester apparatus), U.S. Pat. No. 4,384,552 (gas producing and handling device), and the like. The disclosure of each of these United States patents is hereby incorporated by reference into this specification.

In the preferred embodiment depicted in FIG. 33, waste heat from waste heat recovery systems 1224 and 1226 are preferably fed via line 1227 to the digester 1242, wherein the heat is utilized to aid in the digestion process.

Figure 34:
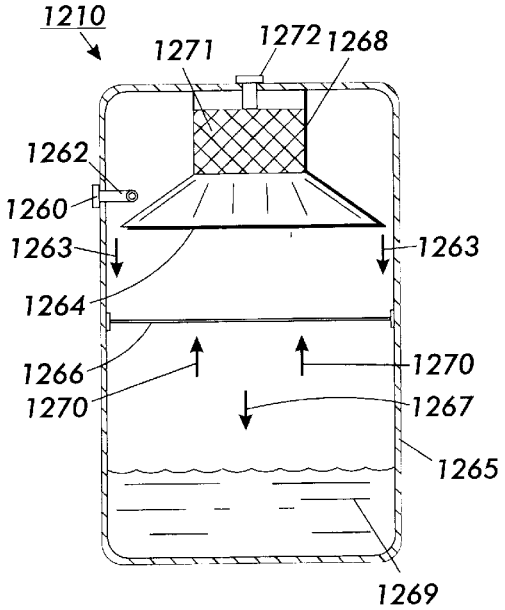
FIG. 34 is a sectional view of the separator used in the process of FIGS. 32 and 33.
Figure 35:
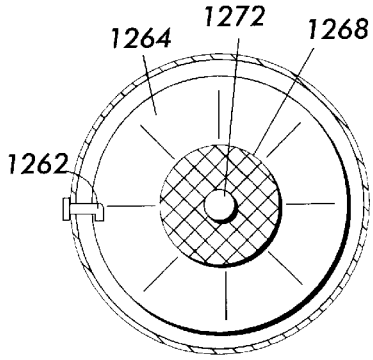
FIG. 35 is a top view of the separator of FIG. 34.

FIG. 34 is a sectional view of a preferred accumulator/separator 1210 which is comprised of a gas inlet port 1260, an elbow 1262, a baffle 1264, a perforated screen 1266, and a vent stack 1268.

Gas is fed into inlet port 1260 and then is fed tangentially by an elbow 1262. The gas is then forced to flow around baffle 1264. In the embodiment depicted, baffle 1264 is a truncated cone. As will be apparent, however, other such baffles may be used, provided that such baffle has diameter which is smaller than the internal diameter of vessel 1265 or otherwise provides communication within vessel 1265.

In one embodiment, instead of using elbow 1262 and tangential injection, linear injection of the gas is achieved with a straight pipe section (not shown).

The gas fed through elbow 1262 is preferably forced downwardly in the direction of arrow 1263 while simultaneously being accelerated in that direction.

The accelerated gas impinges against screen 1266 which disrupts the gas flow and causes liquid to separate from the gas and drop down into the direction of arrow 1267 into liquid pool 1269, while the gas separated from the liquid then flows upwardly in the direction of arrow 1270 through the baffle 1264 and into a vent stack 1268. In the embodiment depicted, vent stack 1268 contains surface impingement/filtering media such as, e.g., steel mesh, nonmetallic filter media, steel wool, which is disposed within the vent stack 1268. The filtered gas preferably flow through outlet port 1272. As will be apparent, this accumulator/separator removes both liquid material and solid material from the gas stream. Other accumulator/separator devices also may be used, including those disclosed in U.S. Pat. Nos. 3,709,292, 3,739,627, 3,763,016, 3,766,745, 3,771,291, 3,773,558, 3,782,463, and the like. The entire disclosure of these United States patents is hereby incorporated by reference into this specification.

Figure 36:
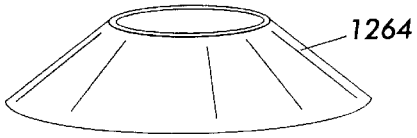
FIG. 36 is a front view of the cone on the separator of FIG. 34.
Figure 37:
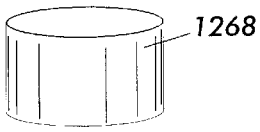
FIG. 37 is a front view of the vent on the separator of FIG. 34.
Figure 38:
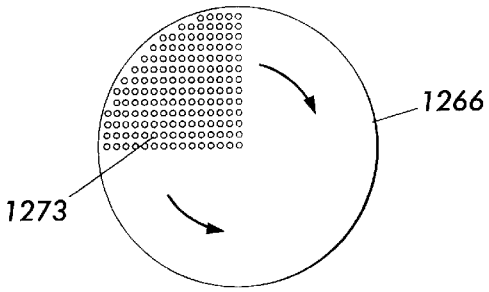
FIG. 38 is partial top view of the perforated plate on the separator of FIG. 34.

FIG. 36 is a front view of baffle 1266. FIG. 37 is a front view of vent stack 1268 from which the filter media 1271 has been omitted for the sake of simplicity of representation. FIG. 38 is a top view of screen 1270 from which the perforations 1273 have been omitted in part for ease of representation.

Figure 39:
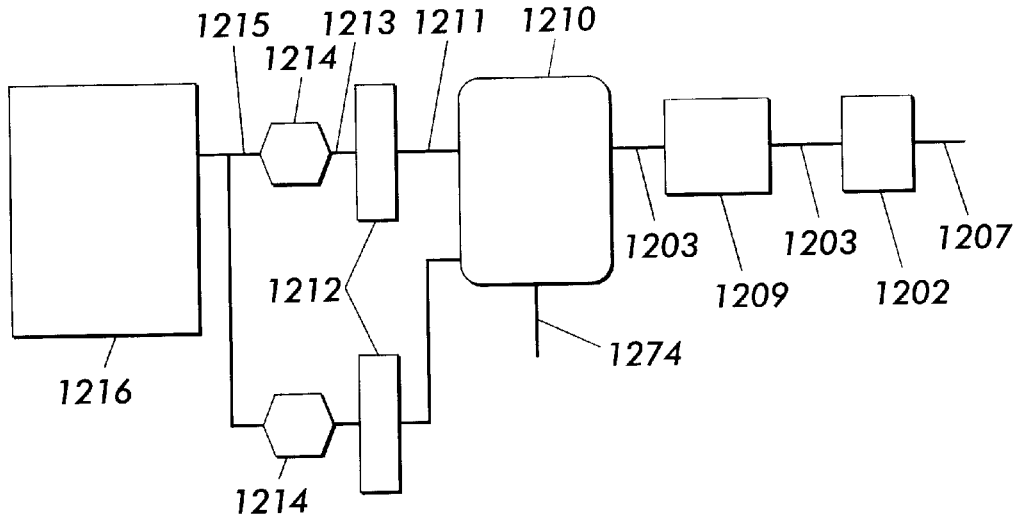
FIG. 39 is a schematic diagram of a separation system for purifying gas.

FIG. 39 is a schematic of an electricity generation system comprised inlet 1207, gas boost system 1202, dehumidification system 1208, accumulator/separator 1210, coalescent filter 1212, pressure regulator 1214, and microturbine(s) 1216. The accumulator/separator 1210 preferably contains a drain vent 1274 from which waste liquid may be removed.

Applicants have discovered that the use of both the accumulator/separator 1210 and the coalescent filter 1212 unexpectedly improves the purification of the gas and tends to minimize the impurities potentially introduced into the microturbine 1216. Applicants have found that, by using two or more different purification mechanisms, an unexpectedly high degree of gas purification is obtained. If one were to use only two accumulator/separators 1274, or only two coalescent filters 1212, the desired degree purification would not be achieved.

In the preferred embodiment depicted in FIG. 39, two coalescent filters 1212 are connected in parallel; they are connected to two pressure regulators 1214, also connected in parallel. Applicants have discovered that the use of two coalescent filters in parallel reduces the velocity of the gas and any remaining liquid through the coalescent filter, thereby increasing the filters' effectiveness. Two coalescent filters of a given size connected in parallel are more effective than one coalescent filter of double the size.

The purified gas stream is then introduced into microturbine 1216.

It is preferred, when practicing the process depicted in FIG. 39, to feed a gas at a pressure of from about 0.1 to about 1,000 p.s.i.g. into line 1207. It is preferred that the gas pressure be from about 0.25 to about 50 p.s.i.g.

The gas is then compressed in booster system 1202 to a pressure level at least 15 pounds per square inch greater than the pressure called for by the microturbine 1216. In general, the gas is compressed in booster system 1202 to a pressure of at least about 65 pounds per square inch.

The pressurized gas is then optionally fed to a dehumidifier 1208, where at least about ten percent is removed. Thereafter, the dehumidified gas is then fed to an accumulator/separator, in which both liquid material and solid material will be removed from the gas stream. In one embodiment, the majority of the liquid material removed is oil.

The material thus treated is then passed to the coalescent filter(s) 1212, which removes liquid material from the accumulator separator.

The process depicted in FIG. 39 is effective with substantially any compressor system. Thus, e.g., it works well with the guided rotor compressor described elsewhere in this specification. Thus, e.g., it works well with scroll compressors, twin-screw compressors, vane compressors, and reciprocating compressors. It is preferred that the compressor system used be an oil lubricated and/or oil flooded compressor. Thus, e.g., one may use a scroll compressor manufactured by the Copeland Company of Sidney, Ohio (see, e.g., U.S. Pat. No. 5,224,357, the entire disclosure of which is hereby incorporated by reference into this specification.)

Figure 40:
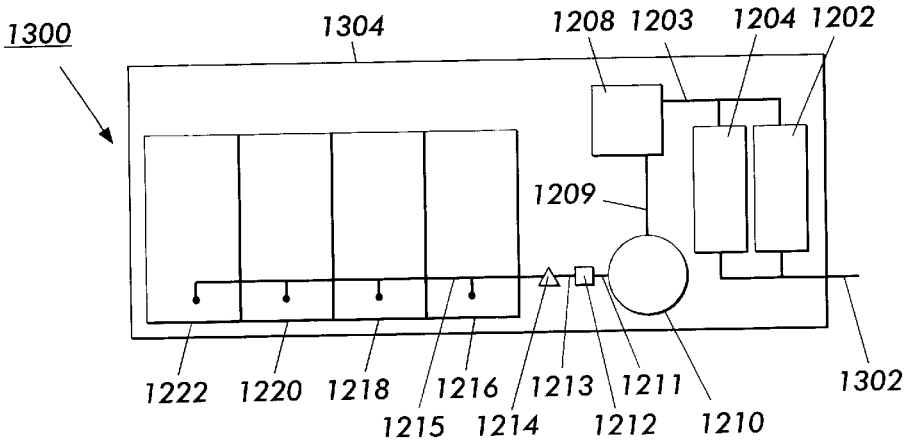
FIG. 40 is a schematic of an electricity generation system packaged on an open skid.

FIG. 40 is a schematic representation of a packaging system 1300 in which gas is introduced via line 1302 into a system mounted on a skid 1304. The configuration of system 1300 is similar to that of system 1200 (see FIG. 32) but differs therefrom in being an "open system" mounted on a skid. The system 1200 may be, but need not be, such an "open system."

As is known to the those skilled in the art, microturbines 1216 et seq. are comprised of cabinets which protect the innards of such microturbines.

Figure 41:
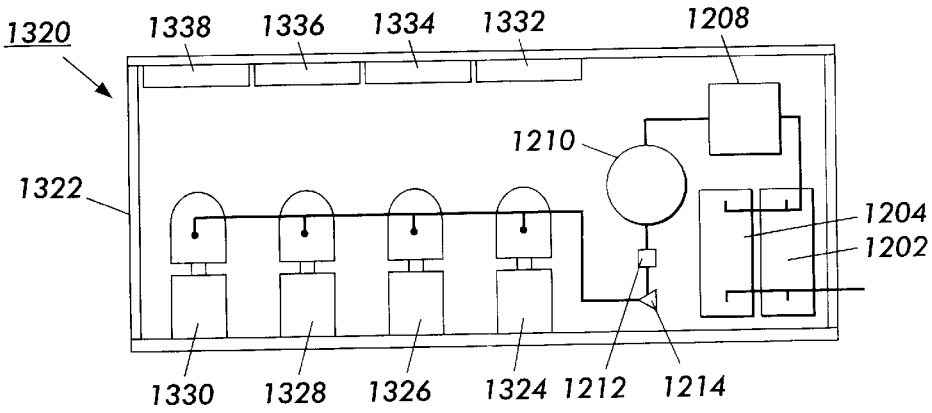
FIG. 41 is a schematic of electricity generation system packaged in a modular fashion.

In the embodiment depicted in FIG. 41, by comparison, the system 1320 is comprised of a enclosure 1322 in which the components of the system are disposed. The enclosure 1322 may be metallic or nonmetallic. In one embodiment, such enclosure is constructed of concrete, as is shown in FIG. 42.

Referring again to FIG. 41, because an enclosure 1322 is used, the individual components mounted within such enclosure 1322 need not be retained within their cabinets. Thus, in the embodiment depicted in FIG. 41, turbogenerators 1324, 1326, 1328, and 1330 (which have been removed from the microturbine cabinets) are utillized in modular form as appropriate. One also may mount components such as the control systems 1332, 1334, 1336, and 1338 (which also have been removed from microturbine cabinets), and/or battery packs (not shown) within the enclosure. As will be apparent, when such an enclosure 1322 is utilized, one has more flexilibility in packaging the components of the microturbine(s) at any desired location(s).

Figure 42:
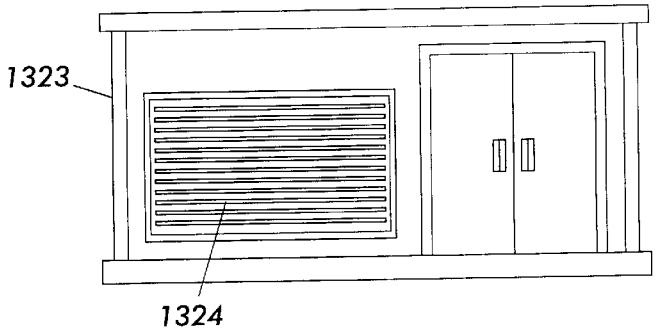
FIG. 42 is a schematic of an electricity generation system disposed within a concrete enclosure.

FIG. 42 is a perspective view of one preferred enclosure 1323, which preferably is made from concrete. One may use precast concrete slabs, precast concrete buildings, or concrete construction on site. The benefit of using such a concrete structure, in addition to the flexibility afforded by modular systems, is the noise attenuation afforded by the use of the concrete. Furthermore, concrete structures are relatively inexpensive and relatively good looking, especially since a variety of architectural styles may be used to construct enclosure 1323.

In the embodiment indicated, the enclosure 1323 is comprised of baffled inlet vents 1324.

Figure 43A:
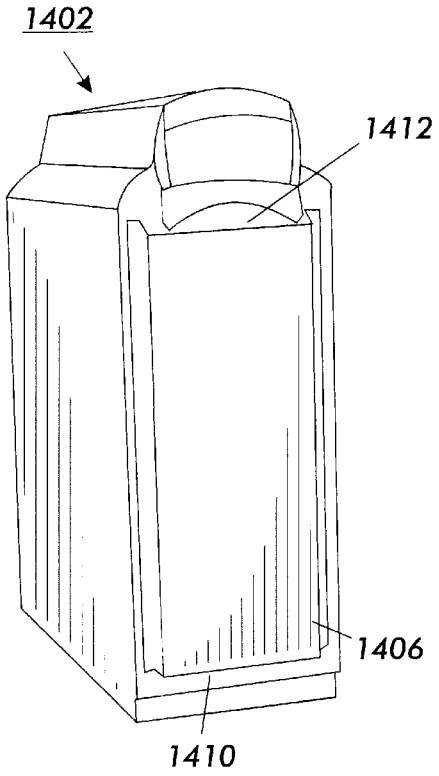
FIGS. 43A and 43B illustrate a sound attenuation device operatively connected to a microturbine.
Figure 43B:
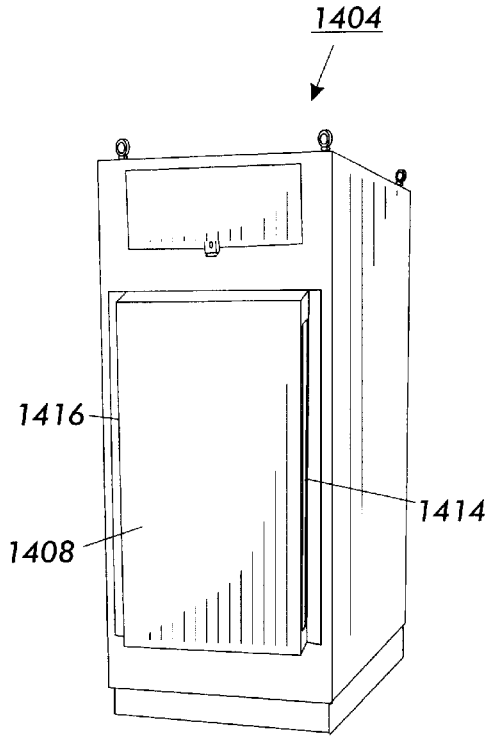

FIGS. 43A and 43B are perspective views of two microturbines 1402 and 1404 which are manufactured by the Capstone Turbine Corporation of Chadsworth, Calif. as models 330 draw out package, and 330 industrial package, respectively. In the embodiments depicted, each of these microturbines generates a noise level of about 65 dba at ten meters. This noise often has an unpleasant, high frequency component which can attenuated by the addition of baffles 1406 and 1408.

The baffles may be made out, or may comprise, sound absorbing material. Thus, e.g., the baffle can be made out of a rigid thermoplastic material to which is affixed a layer of sound absorbent material. Alternatively, the baffle can be made out of a metallic material to which a sound absorbent material has been affixed.

In any case, means for flowing air to the microturbine must be provided. In the embodiment depicted in FIG. 43A, air flows into the system through the bottom opening 1410 and the top opening 1412. Similarly, in the embodiment depicted in FIG. 43B, air flows into the system through the side openings 1414 and 1416.

Figure 43C:
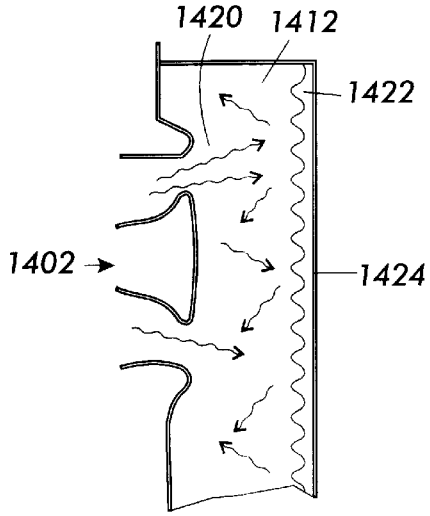

FIG. 43C is a partial sectional view of one preferred interior surface of baffle 1402. Referring to FIG. 43C, it will be seen that sound waves 1420 emanating from the microturbine 1402 will preferably be reflected by and absorbed by the irregular surfaces 1422 disposed on the interior surface 1402. Air is allowed to enter via opening 1412, and some sound escapes through such opening; but, preferably, most of the sound is absorbed.

Figure 21A:
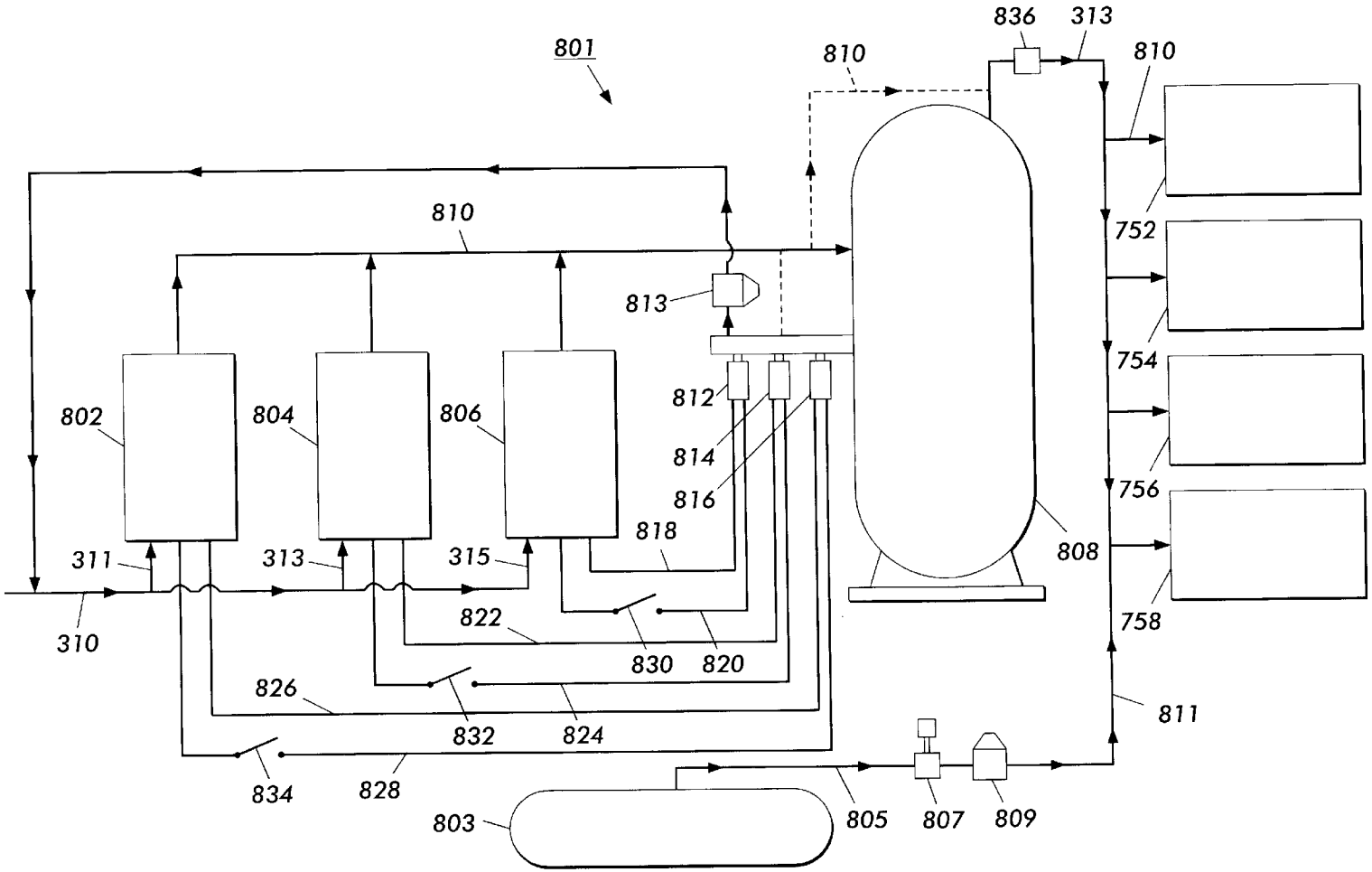

FIG. 21 A illustrates an electricity generation system similar to that depicted in FIG. 21 with the exception the system 801 of FIG. 21A is comprised of a supplemental means of providing fuel to the system. In case the supply of natural gas is somehow interrupted, one may use propane gas from propane tank 803 which flows though line 805 to valve 807. Valve 807 may either be a solenoid valve, or a manual valve.

When valve 807 is open in an emergency, the gas passing through such valve is generally at a pressure higher than that required by the microturbines 752, 754, 756, and 758. Thus, pressure regulator 809 reduces the gas pressure to the desired amount. Furthermore, in the embodiment depicted in FIG. 21A, a back pressure regulator 313 is disposed between the accumulator/separator 808 and the supply manifold 310 which supplies compressors 802, 804, and 806. As will be apparent to those skilled in the art, this back pressure regulator is preferably set at a level slightly lower than highest turn off pressure for pressure transducers 812, 814, and 816 so that, in all cases, at least one compressor 802, 804, or 806 will run continuously even when loading on the microturbines and the gas requirement is low.

In one embodiment, not shown, check valves are utilized which prevent the propane gas from leaking into the natural gas supply lines, and vice versa. However, the propane gas, when used, is caused to flow into the manifold 313 from line 811.

Figure 44:
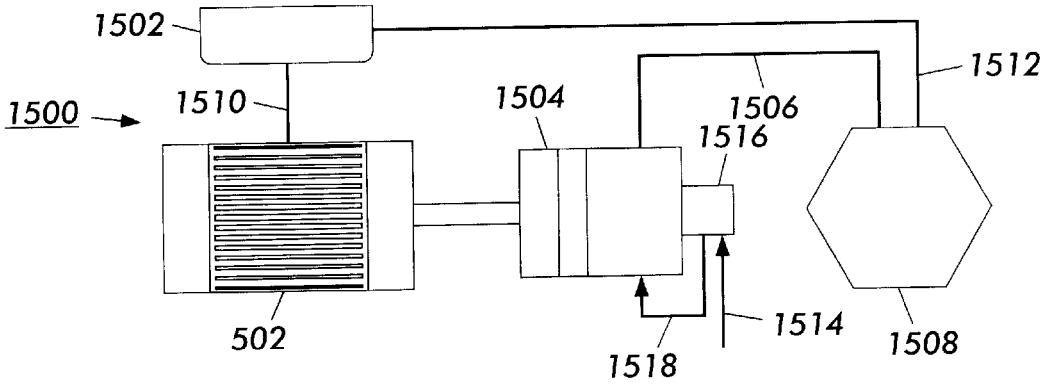
FIG. 44 is a schematic of a power generation system containing a prime mover, a compressor, and metering pump.

FIG. 44 is a schematic representation of a generation system 1500 comprising an electric motor 502 operatively connected to a variable speed drive 1502; this variable speed assembly drives compressor 1504 whose output is fed via line 1506 to prime mover 1508.

One may use any of the variable speed drives known to those skilled in the art. Thus, e.g., one may use one or more of the variable speed drives disclosed in U.S. Pat. No. 6,102,671 (scroll compressor operable at variable speeds), U.S. Pat. Nos. 6,041,615, 5,964,807, 5,894,736, 5,746,062, and the like. The entire disclosure of each of these United States patents is hereby incorporated by reference into this specification.

Thus, by way of further illustration, one may use an "Adjustable Speed AC Motor Controller" sold as "Fincor 6500" by the B&B Motor and Control Corporation of Rochester, N.Y.

Referring again to FIG. 44, the variable speed drive 1502 is operatively connected to motor 502 and controls its speed in response to information fed to drive 1502 from motor 502 (fed via line 1510), and also in response to information fed to drive 1502 from prime mover 1508 (and fed via line 1512). As the need for compressed gas from compressor 1504 varies, the speed of motor 502 will vary.

Assembly 1508 is any prime mover assembly which converts natural gas to electrical energy. Such prime mover assembly 1508 may be a microturbine (as discussed elsewhere in this specification), a fuel cell, a reciprocating engine, etc. The prime mover assembly includes a sensing means adapted to determine the gas pressure within the prime mover assembly and to activate the electric motor 502 to either deliver more or less gas, or to shut off, or to start. Thus, by way of illustration an not limitation, and referring to FIG. 21, pressure transducers (not shown) may be substituted for the controllers 812, 814, and 816 and operatively connected to the variable speed drive 1502.

Referring again to FIG. 44, and in the preferred embodiment depicted therein, liquid is fed via line 1514 into liquid injection metering pump 1516. One may use any of the liquid metering pumps known to those skilled in the art such as, e.g., one or more of the metering pumps disclosed in U.S. Pat. Nos. 6,123,324, 6,012,903 (positive displacement liquid metering pump), U.S. Pat. Nos. 4,349,130, 4,236,881, 4,021, 153, and the like. The entire disclosure of each of these United States patents is hereby incorporated by reference into this specification.

In the embodiment depicted in FIG. 44, the metering pump 1516 is operatively connected to motor 502 and compressor 1504 so that, as the speed of motor 502 is varied, the amount of liquid pumped by pump 1516 is also varied. The fluid pumped by pump 1516 lubricates and seals the compressor 1504.

The liquid fed into line 1514 may be oil, it may be water, or it may be the liquid phase of the gas being compressed., or it may be a mixture of the above. The liquid may be fed to the compressor via external line 1518 and/or via internal passageways (not shown).

In one embodiment, the liquid being pumped is oil. In another embodiment, the liquid being pumped is water. In either case, it is preferred that the pump 1516 be capable of compressing the liquid prior to feeding it into compressor 1504. In general, the pressure of the liquid being injected into the compressor 1504 will be from about 1 pounds per square inch gage to about 500 pounds per square inch gage and, preferably, from about 2 pounds per square inch gage to about 180 pounds per square inch gage.

When the fluid entering pump 1516 is at the desired pressure, there will be no need to further pressurize it with pump 1516. When the pressure of the fluid entering the pump 1516 is too high, the metering device within the pump will reduce the flow of the fluid to the desired amount. When the pressure of the fluid entering the pump 1516 is too low, its pressure will be increased by the metering pump in order to maintain the desired flow rate.

FIGS. 45A through 45D illustrate various configurations involving electric motor 502, compressor 1504, and metering pump 1516. In these Figures, for the sake of simplicity of representation, the variable speed drive 1502 and prime mover 1508 have been omitted.

In each of the embodiments depicted in FIGS. 45A through 45D, a coupling 1520 may be used to couple motor 502 to the compressor 1504. These couplings are well known to those skilled in the art. It is preferred that coupling 1520 be torsionally rigid.

Figure 45A:
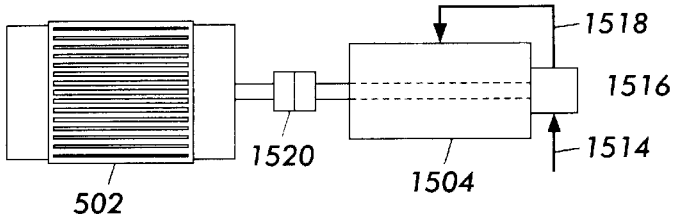
FIGS. 45A, 45B,45C, and 45D are schematic of different pump/compressor assemblies.

In the embodiment depicted in FIG. 45A, the compressor 1504 is directly connected to the motor 502 by coupling 1520. The motor 502 also is operatively connected to the pump 1516.

Figure 45B:
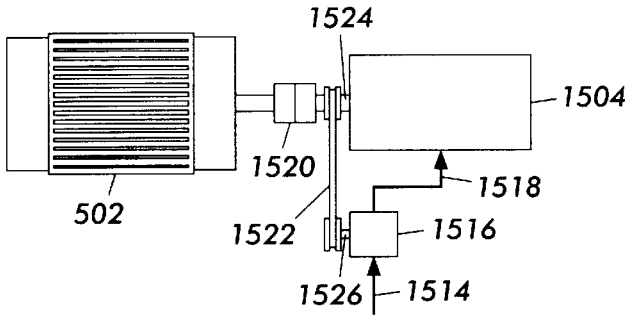

In the embodiment depicted in FIG. 45B, a belt, chain, or gear set 1522 is connected to shaft 1524, which in turn cases rotation of shaft 1526 and operation of pump 1516.

Figure 45C:
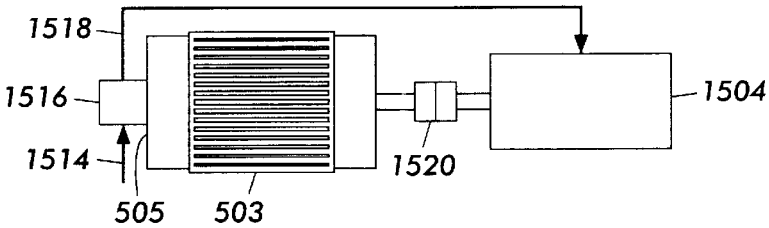

In the embodiment depicted in FIG. 45C, a double-shafted motor 503 is utilized. End 505 of motor 503 is operatively connected to pump 1516, which delivers fluid via line 1518 to compressor 504.

Figure 45D:
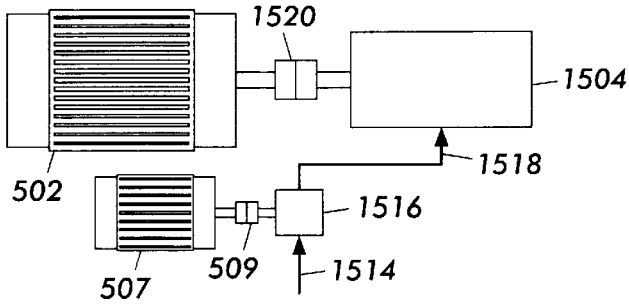

In the embodiment depicted in FIG. 45D, a separate motor 507 is coupled via coupling 1520 to pump 1516, which is hydraulically connected to compressor 1504 via line 1518. In the embodiment depicted in FIG. 45D, it is preferred that motor 507 be driven by its own variable speed drive (not shown). It is preferred, in this embodiment, that the speed of motor 507 be synchronized with the speed of motor 502.

Figure 46A:
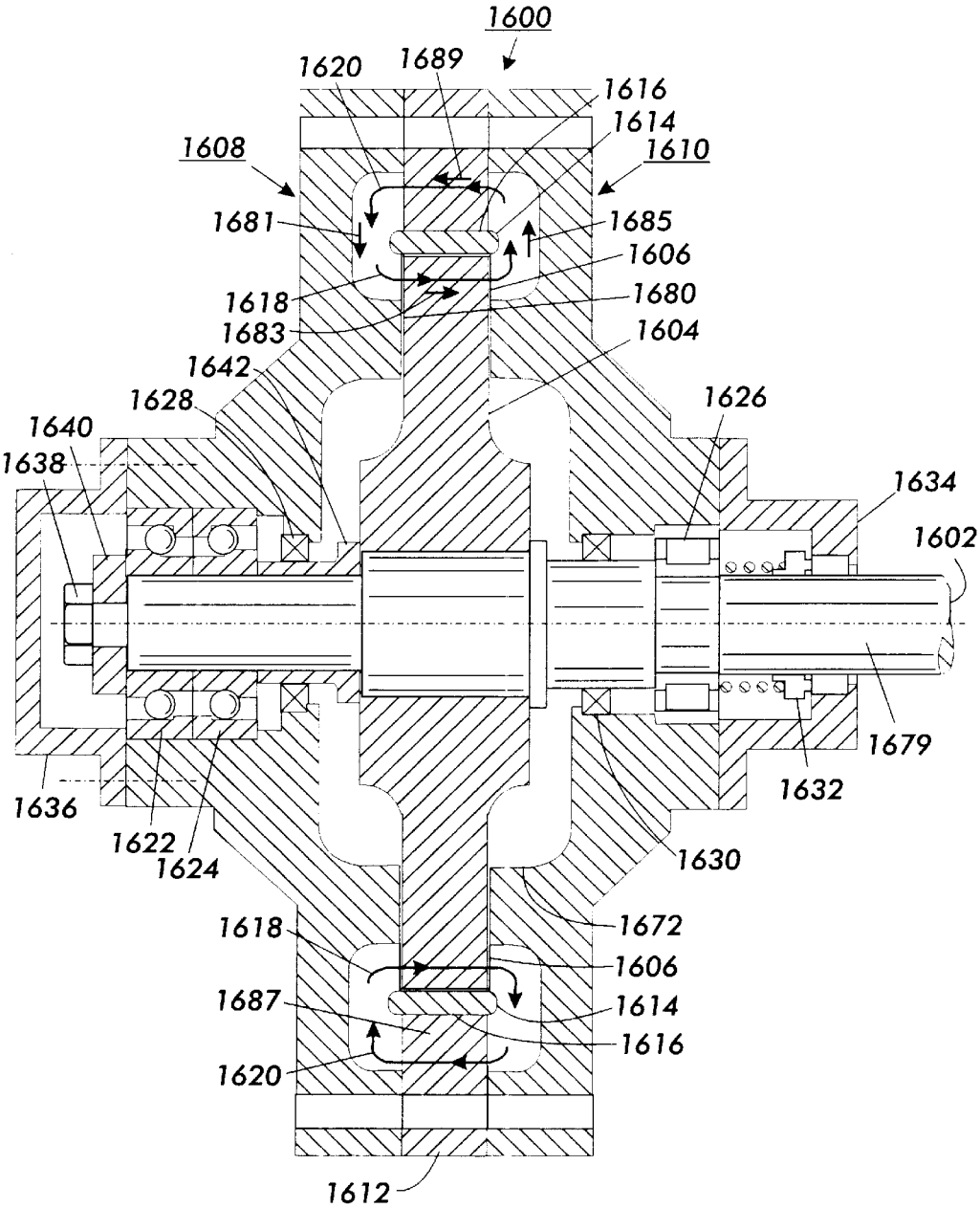
FIG. 46A is a sectional view of a novel compressor.

A novel compressor 1600 is illustrated in FIG. 46A. Referring to FIG. 46A, it will be seen that compressor 1600 is comprised of shaft 1602 on which is mounted rotor 1604. The rotor 1604 is disk-shaped; air foils/vanes (not shown) are disposed at periphery 1606 of the rotor 1604.

The rotor 1604 is disposed between suction side stator 1608 and discharge side stator 1610. Intermediate stator 1612 also is disposed between suction side stator 1608 and discharge side stator 1610.

Flow separator 1614 is attached to the inner diameter 1616 of the intermediate stator 1612.

Rotor 1604 is comprised of a multiplicity of upstanding air foils which cause gas to flow in the direction of arrow 1618, axially through the rotor 1604, and then radially through discharge side stator 1610 and, thereafter in the direction of arrow 1620, axially through the intermediate stator 1612, and then radially through suction side stator 1608.

The shaft 1602 is supported by bearings 1622 and 1624 as well as by roller bearing 1626. A lip seal 1628 is disposed on the suction stator 1608. Another lip seal 1630 is disposed on the discharge side stator 1610. The lip seals are adapted to retain lubricant (not shown) within the bearing assemblies. Similarly, a drive shaft seal 1632 prevents lubricant and/or gas from leaking from the compressor 1600.

A drive end cover 1634 is attached to the discharge stator side 1610. An end plate/cover 1636 is attached to the suction side stator 1608. A fastener 1638 holds the bearing assembly in place by means of washer 1640. Positioning collar 1642 helps align the shaft 1602.

Figure 46C:
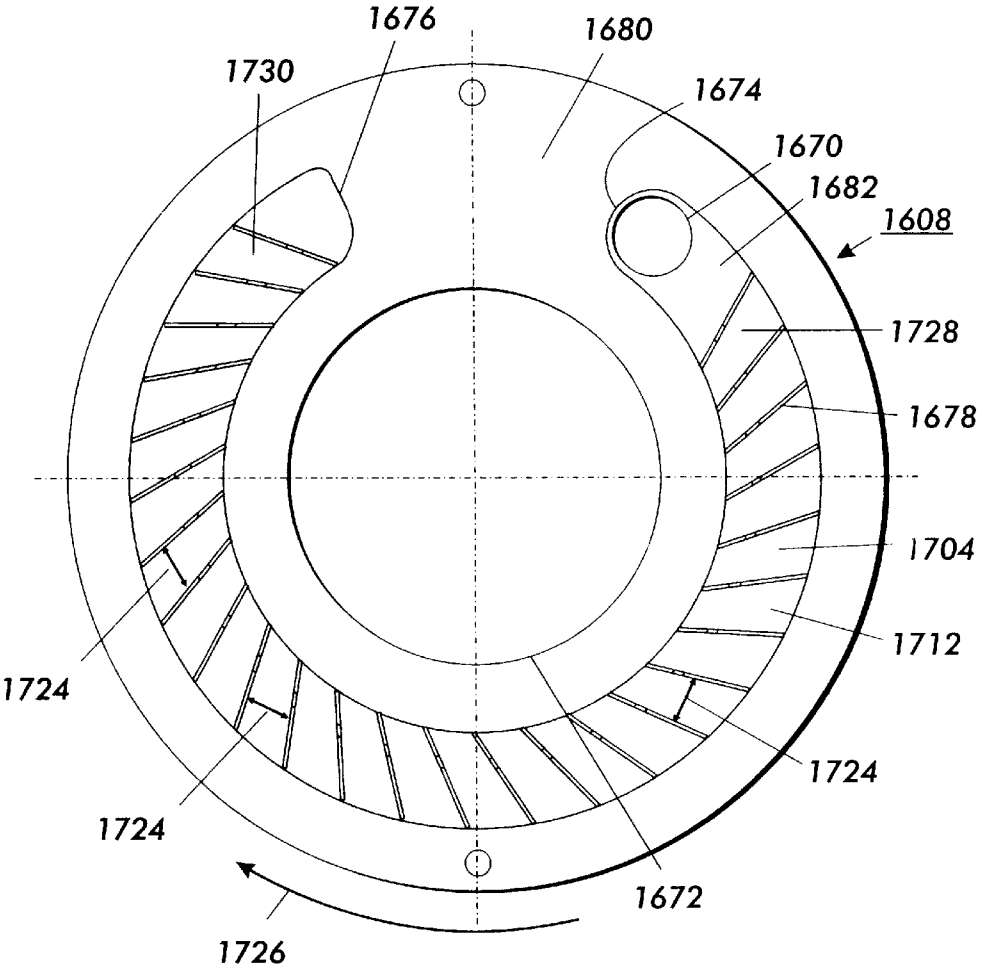
FIG. 46C is a side view of the suction side stator of the compressor of FIG. 46A.
Figure 46B:
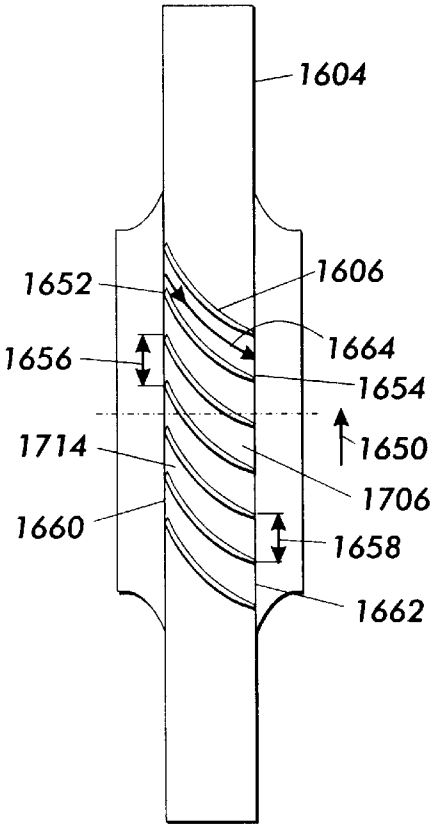
FIG. 46B is a top view of the rotor of the compressor of FIG. 46A.

FIG. 46B is a side view of rotor 1604. As will be seen, rotor 1604 is comprised of a multiplicity of vanes 1606; only some of these vanes are shown in FIG. 46B for the sake of simplicity of representation.

The vanes 1606 are preferably disposed about the periphery of rotor 1604 in a manner which is substantially equidistant. Thus, if there are only four such vanes 1606, there preferably will be one such vane per 90 degree quadrant. If there are 8 such vanes, there will be one such vane per 45 degree quadrant.

It is preferred that there be from about 20 to about 100 such vanes 1606 be disposed equidistantly around the periphery of rotor 1604. The air foils 1606 preferably have a leading edge and a trailing edge defining an axial chord length therebetween, each of said airfoils, and they further comprise a convex suction surface and a concave pressure surface intersecting at said leading edge and said trailing edge, wherein each of said suction surfaces comprises an accelerating flow section and a decelerating flow section downstream of said accelerating flow section, wherein said first and said second adjacent airfoils define a throat between said trailing edge of said second airfoil and the nearest point on said suction surface of said first airfoil, and wherein said accelerating flow section of said first airfoil extends downstream of said throat. Such an airfoil is described, e.g., in U.S. Pat. No. 6,022,188, the entire disclosure of which is hereby incorporated by reference into this specification.

In the preferred embodiment depicted in FIG. 46B, the rotor 1604 preferably rotates clockwise, in the direction of arrow 1650, as viewed the right side. The airfoils 1606 have a leading edge 1652 (on the suction side), a trailing edge 1654 (on the discharge side), and a configuration such that the distance 1656 between adjacent leading edges 1652 is smaller than the distance 1658 between adjacent trailing edges 1654. Because of this differential in distance, there is a static pressure increase and a velocity decrease of gas between point 1660 and 1662. Consequently, the gas being compressed will tend to flow axially in the direction of arrow 1664.

The airfoils 1606 extend radially outwardly from the periphery of stator 1604 a distance which is about 30 percent or less than the radius of rotor 1604. It is preferred that the airfoils extend outwardly a distance of less than about 10 percent of the radius of the rotor 1604.

In the preferred embodiment depicted in FIG. 46B, each of airfoils 1606 has a substantially arcuate shape. In another embodiment, not shown, each of airfoils 1606 has a substantially non-arcuate shape.

The airfoils 1606 may be formed by conventional means. Thus, e.g., they may be cast in place, machined in place from a solid billet, or separately formed and then attached to the periphery of the rotor 1606.

FIG. 46C is a side view of suction side stator 1608 from which unnecessary detail has been omitted for the sake of simplicity of representation. Referring to FIG. 46C, it will be seen that suction side stator 1608 is comprised of intake port 1670 and opening 1672. An arcuate channel is defined between points 1674 and 1676 and is formed in the surface of plate 1608, and is open at the plane 1680 (see FIG. 46A). Disposed within arcuate channel are a multiplicity of upstanding stator vanes 1678 which extend upwardly towards the plane 1680 of suction side stator plate (see FIG. 46A) from the bottom annular surface (not shown) of the channel. In another embodiment, not shown, the stator vanes 1678 are not orthogonal to the plane 1680 but, instead, are disposed at an acute or obtuse angle thereto.

The adjacent stator vanes 1678 form closed segments of the arcuate channel. The gas which is compressed may flow into the intake port 1670 and, initially, fills up entrance chamber 1682; the gas flows inwardly towards the centerline 1679 of the driveshaft 1602 in the direction of arrow 1681. Thereafter, the gas will flow in the direction of arrow 1683 within rotor 1604, into a space between adjacent vanes/airfoils 1606; during this portion of the gas flow, the gas will be flowing substantially axially. Thereafter, the gas will be introduced into the discharge side stator 1610, in particular, into the entrance chamber of the discharge stator 1702 in the direction of arrow 1685, which is radially outward from centerline 1679 of driveshaft 1602. Thereafter, the gas will enter the intermediate stator 1612 into a space between stationary adjacent vanes/airfoils 1687 in the direction of arrow 1689, substantially axially. Thereafter the gas will reenter the suction side stator 1608.

Figure 46E:
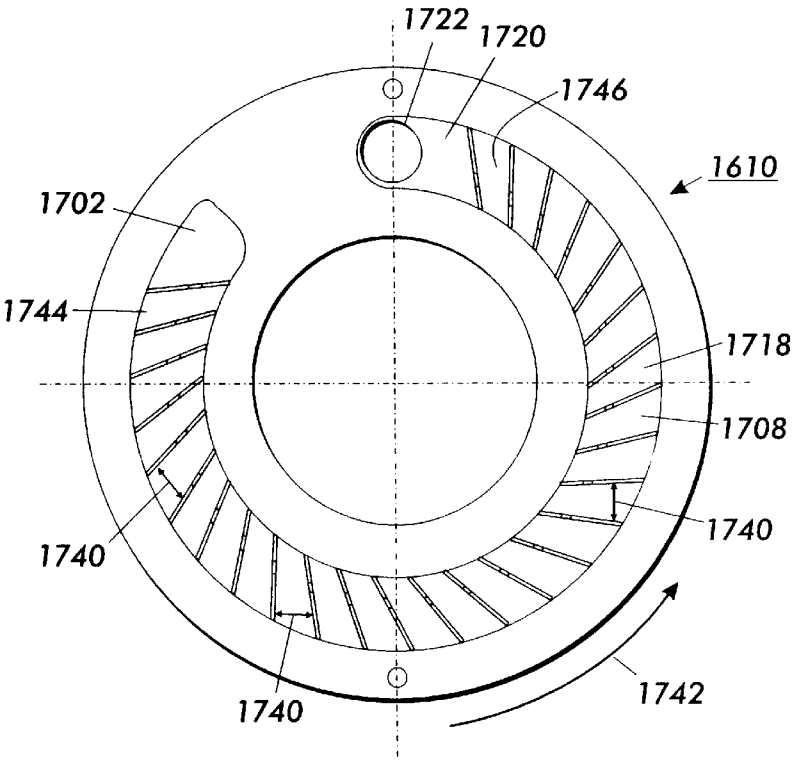
FIG. 46E is a side view of the discharge side stator of the compressor of FIG. 46A.
Figure 46D:
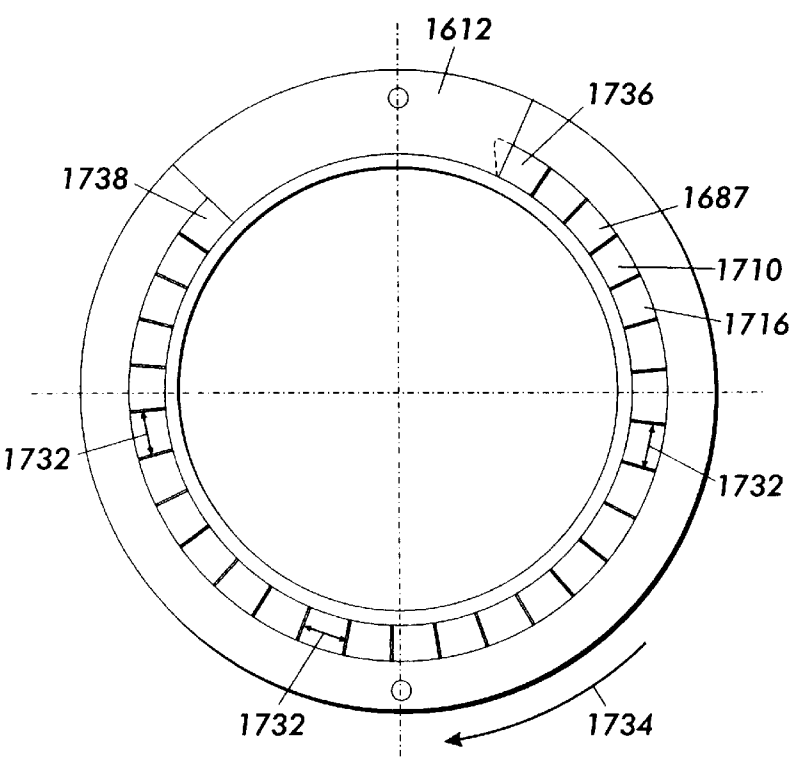
FIG. 46D is a side view of an intermediate stator of the compressor of FIG. 46A.

As will be apparent to those skilled in the art, and referring to FIG. 46C, the gas flows helically through the assembly of the suction side stator 1608, the rotor 1604, the discharge side stator 1610, and the intermediate stator 1612 (see FIG. 46C) from one vane compartment 1704 (see FIG. 46C), to a second vane compartment 1706 (see FIG. 46B), to a third vane compartment 1708 (see FIG. 46E), to a fourth vane compartment 1710 (see FIG. 46D), to a fifth vane compartment 1712 (see FIG. 46C), to vane compartment 1714 in rotor 1604 (see FIG. 46B), and then to vane compartment 1716 in intermediate stator 1612 (see FIG. 46D), and then to vane 1718 in discharge side stator 1610 (see FIG. 46E). This process is repeated until the gas flows through each of the vane compartments illustrated in FIGS. 46B, 46C, 46D, and 46E and finally reaches exit chamber 1720 and thereafter discharges through discharge port 1722 (see FIG. 46E).

As will be apparent those skilled in the art, as the gas flows around each vane and into the next succeeding vane compartment, the static pressure increases in accordance with Bernoulli's equation and the pressure consequently increases.

In the embodiment depicted in FIG. 46C, the vanes compartments are shown having substantially constant volumes and are separated by a distance 1724 which is preferably substantially the same between any two adjacent vanes; in this embodiment, the vane compartments are spaced substantially equidistantly from each other. In another embodiment, not shown, the vane spacing will vary as one proceeds in the direction of arrow 1726, preferably decreasing from point 1728 to point 1730, preferably in relationship to the decrease in specific volume. As will be apparent, this continual decrease in the vane spacing will cause an continual increase in the gas pressure.

In the embodiment depicted in FIG. 46C, the vanes compartments are shown having substantially constant volumes and are separated by a distance 1732 which is preferably substantially the same between any two adjacent vanes; in this embodiment, the vane compartments are spaced substantially equidistantly from each other. In another embodiment, not shown, the vane spacing will vary as one proceeds in the direction of arrow 1734, preferably decreasing from point 1736 to point 1738, preferably in relationship to the decrease in specific volume. As will be apparent, this continual decrease in the vane spacing will cause an continual increase in the gas pressure.

In the embodiment depicted in FIG. 46E, the vanes compartments are shown having substantially constant volumes and are separated by a distance 1740 which is preferably substantially the same between any two adjacent vanes; in this embodiment, the vane compartments are spaced substantially equidistantly from each other. In another embodiment, not shown, the vane spacing will vary as one proceeds in the direction of arrow 1742, preferably decreasing from point 1744 to point 1746, preferably in relationship to the decrease in specific volume. As will be apparent, this continual decrease in the vane spacing will cause an continual substantially constant volumes and are separated by a distance 1724 which is preferably substantially the same between any two adjacent vanes; in this embodiment, the vane compartments are spaced substantially equidistantly from each other. In another embodiment, not shown, the vane spacing will vary as one proceeds in the direction of arrow 1726, preferably decreasing from point 1728 to point 1730, preferably in relationship to the decrease in specific volume. As will be apparent, this continual decrease in the vane spacing will cause an continual increase in the gas pressure.

In the embodiment depicted in FIG. 46C, the vanes compartments are shown having substantially constant volumes and are separated by a distance 1732 which is preferably substantially the same between any two adjacent vanes; in this embodiment, the vane compartments are spaced substantially equidistantly from each other. In another embodiment, not shown, the vane spacing will vary as one proceeds in the direction of arrow 1734, preferably decreasing from point 1736 to point 1738, preferably in relationship to the decrease in specific volume. As will be apparent, this continual decrease in the vane spacing will cause an continual increase in the gas pressure.

In the embodiment depicted in FIG. 46E, the vanes compartments are shown having substantially constant volumes and are separated by a distance 1740 which is preferably substantially the same between any two adjacent vanes; in this embodiment, the vane compartments are spaced substantially equidistantly from each other. In another embodiment, not shown, the vane spacing will vary as one proceeds in the direction of arrow 1742, preferably decreasing from point 1744 to point 1746, preferably in relationship to the decrease in specific volume. As will be apparent, this continual decrease in the vane spacing will cause an continual increase in the gas pressure.

The stator vanes 1678 are connected to an semi-annular plate 1608 which is disposed on the top of the arcuate closed channel and forms its top wall.

FIG. 47A is schematic diagram of a power generation system 1800. Referring to FIG. 47A, microturbine 456 generates direct current electrical power which is fed via line 1802 to motor controller 1804, which controls the voltage supplied via line 1806 to direct current motor 1808. A internal sensor 1810 monitors the speed of direct current motor 1808 and, when appropriate, feeds information via line 1812 to motor controller via feedback line 1814 to motor controller 1804, which in turn either increases or decreases the speed of direct current motor 1808. Direct current motor 1808 is connected via shaft 1816 to coupling 1818 which, in turn, drives shaft 1820. Shaft 1820 is connected to alternating current generator 1822. As will be apparent, by this system, a regulated alternating current output is produced which is fed via line 1824.

The power generation system 1830 depicted in FIG. 47B is similar to that depicted in FIG. 47A with the exception that it contains a flywheel 1832 disposed on shaft 1816 and/or shaft 1820. As will be apparent to those skilled in the art, the inertial mass presented by flywheel 1832 increases the regulation of the system and helps insure a more uniform alternating current output via line 1824.

The power generation system 1850 depicted in FIG. 47C is similar to the device 1830 depicted in FIG. 47B with the exception that a battery pack 1852 is electrically connected via line 1854 to the output 1802 of microturbine assembly 456. Microturbine assembly 456 frequently is called upon to start or stop when transient load demands are presented to the system. The inertia-imparting devices illustrated in FIGS. 47B and 47C help smooth out the operation of the microturbine 456. As will be apparent, the battery pack 1852 provides electrical inertia in the same manner as the flywheel 1832 provides kinematic inertia.

The battery pack 1852 preferably provides direct current. In one embodiment, each battery cell in the battery pack provides 1.5 volt output. It is preferred that, in one embodiment, battery pack 1804 provides from about 250 to about 300 volts of direct current power.

The battery pack 1852 depicted in FIG. 47C may optionally also be used in the system of FIG. 47A.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A process for generating electricity, comprising:

(a) feeding a mixture of gas and liquid at a pressure of from about 0.25 to about 50 pounds per square inch gauge to a compressor, (b) compressing said mixture of gas and liquid to a pressure of at least about 65 pounds per square inch gauge, thereby producing a mixture comprised of compressed gas and liquid, (c) feeding said mixture comprised of said compressed gas and liquid to an accumulator/separator in which liquid material and solid material is removed from said mixture of compressed gas and liquid, thereby producing a first purified mixture of gas and liquid, (d) feeding said first purified mixture of gas and liquid to a coalescent filter in which liquid material is removed from said first purified mixture of gas and liquid, thereby producing a second purified gas, (e) feeding said second purified gas to a pressure regulator and reducing the pressure of said second purified gas, thereby producing a reduced pressure second purified gas, (f) feeding said reduced pressure second purified gas to a microturbine, (g) combusting said reduced pressure second purified gas in said microturbine, thereby producing a first direct current in a first electrical line, and (h) feeding said first direct current to a direct current motor and causing said direct current motor to rotate, and (i) driving an generator with said direct current motor and producing alternating current from said generator.

2. The process as recited in claim 1, wherein said accumulator/separator is comprised of a baffle for disrupting the flow of said mixture of compressed gas and liquid.

3. The process as recited in claim 2, wherein said baffle is in the shape of a truncated cone.

4. The process as recited in claim 2, wherein said accumulator/separator is comprised of means for introducing said mixture of compressed gas and liquid into said accumulator/separator in a tangential manner.

5. The process as recited in claim 2, wherein said accumulator/separator is comprised of perforated plate which disrupts the flow of said compressed gas and liquid through said accumulator/separator.

6. The process as recited in claim 5, wherein said accumulator/separator is comprised of a vent stack.

7. The process as recited in claim 6, wherein filtering material is disposed within said vent stack.

8. The process as recited in claim 7, wherein said filtering material is steel mesh.

9. The process as recited in claim 7, wherein said filtering material is steel wool.

* * * * *